US008577076B2

(12) United States Patent
Ohashi et al.

(10) Patent No.: US 8,577,076 B2
(45) Date of Patent: Nov. 5, 2013

(54) SPEAKER DEVICE

(75) Inventors: Yoshio Ohashi, Kanagawa (JP); Nobukazu Suzuki, Kanagawa (JP)

(73) Assignee: Sony Corporation (JP)

( * ) Notice: Subject to any disclaimer, the term of this patent is extended or adjusted under 35 U.S.C. 154(b) by 103 days.

(21) Appl. No.: 13/169,312

(22) Filed: Jun. 27, 2011

(65) Prior Publication Data

US 2012/0008818 A1 Jan. 12, 2012

(30) Foreign Application Priority Data

Jul. 7, 2010 (JP) ..... P2010-155121

(51) Int. Cl.
*H04R 11/02* (2006.01)

(52) U.S. Cl.
USPC ..... 381/423; 381/349; 381/429

(58) Field of Classification Search
USPC ..... 381/432, 423, 396, 407; 181/165
See application file for complete search history.

(56) References Cited

U.S. PATENT DOCUMENTS

| | | | | |
|---|---|---|---|---|
| 4,559,584 | A | 12/1985 | Kuwahata et al. | |
| 4,699,242 | A | 10/1987 | Ono | |
| 5,329,072 | A | 7/1994 | Kageyama et al. | |
| 5,703,337 | A * | 12/1997 | Geisenberger | 181/206 |
| 2004/0218778 | A1 * | 11/2004 | Weisman | 381/396 |
| 2005/0207612 | A1 * | 9/2005 | D'Hoogh | 381/423 |
| 2007/0133837 | A1 | 6/2007 | Suzuki et al. | |
| 2008/0053745 | A1 * | 3/2008 | Tada et al. | 181/165 |
| 2009/0060253 | A1 * | 3/2009 | Imamura et al. | 381/407 |

FOREIGN PATENT DOCUMENTS

| | | | |
|---|---|---|---|
| GB | 355405 | A | 8/1931 |
| JP | 7-28478 | | 3/1995 |
| JP | 2002-152888 | A | 5/2002 |
| JP | 2007-166027 | A | 6/2007 |
| JP | 2008-310055 | A | 12/2008 |

OTHER PUBLICATIONS

European Search Report EP 11170925, dated Sep. 29, 2011.

* cited by examiner

*Primary Examiner* — Davetta W. Goins
*Assistant Examiner* — Amir Etesam
(74) *Attorney, Agent, or Firm* — Lerner, David, Littenberg, Krumholz & Mentlik, LLP

(57) ABSTRACT

A speaker device includes: an acoustic diaphragm having a given shape and made of a material having physical anisotropy; and an excitation means attached to the acoustic diaphragm for exciting vibration components in consideration of a direction corresponding to the physical anisotropy.

7 Claims, 19 Drawing Sheets

APPEARANCE STRUCTURE OF SPEAKER DEVICE IN SECOND EMBODIMENT

400

ENTIRE STRUCTURE OF SPEAKER DEVICE IN RELATED ART

STRUCTURE OF SPEAKER DEVICE USING ACOUSTIC DIAPHRAGM HAVING PHYSICAL ANISOTROPY (1)

STRUCTURE OF SPEAKER DEVICE USING ACOUSTIC DIAPHRAGM HAVING PHYSICAL ANISOTROPY (2)

STRUCTURE OF SPEAKER DEVICE USING ACOUSTIC DIAPHRAGM HAVING PHYSICAL ANISOTROPY (3)

METHOD OF GIVING PHYSICAL ANISOTROPY (1)

METHOD OF GIVING PHYSICAL ANISOTROPY (2)

DRIVING DIRECTION AND FREQUENCY CHARACTERISTICS WITH RESPECT TO WOOD

CASE OF EXCITATION IN DIRECTION ORTHOGONAL TO STRAIGHT GRAIN

CASE OF EXCITATION IN STRAIGHT GRAIN DIRECTION

APPEARANCE STRUCTURE OF SPEAKER DEVICE IN FIRST EMBODIMENT

UPPER-SURFACE AND SIDE-SURFACE STRUCTURES OF SPEAKER DEVICE IN FIRST EMBODIMENT

BOTTOM SURFACE STRUCTURE OF SPEAKER DEVICE IN FIRST EMBODIMENT

CROSS-SECTIONAL STRUCTURE OF SPEAKER DEVICE IN FIRST EMBODIMENT

STRAIGHT GRAIN DIRECTION AND EXCITATION DIRECTION OF ACTUATOR IN FIRST EMBODIMENT

SOUND-PRESSURE LEVEL FREQUENCY CHARACTERISTICS USING ACRYLIC AS ACOUSTIC DIAPHRAGM

SOUND-PRESSURE LEVEL FREQUENCY CHARACTERISTICS USING WOOD AS ACOUSTIC DIAPHRAGM

CONFIGURATION OF DRIVING SYSTEM OF SPEAKER SYSTEM IN FIRST EMBODIMENT

APPEARANCE STRUCTURE OF SPEAKER DEVICE IN SECOND EMBODIMENT

400

UPPER-SURFACE AND SIDE-SURFACE STRUCTURES OF SPEAKER DEVICE IN SECOND EMBODIMENT

BOTTOM SURFACE STRUCTURE OF SPEAKER DEVICE IN SECOND EMBODIMENT

CROSS-SECTIONAL STRUCTURE OF SPEAKER DEVICE IN SECOND EMBODIMENT

STRAIGHT GRAIN DIRECTION AND EXCITATION DIRECTION OF ACTUATOR IN SECOND EMBODIMENT

ATTACHING STATE OF ACTUATORS IN ANOTHER EMBODIMENT (1)

ATTACHING STATE OF ACTUATORS IN ANOTHER EMBODIMENT (2)

ATTACHING STATE OF ACTUATORS IN ANOTHER EMBODIMENT (3)

ATTACHING STATE OF ACTUATORS IN ANOTHER EMBODIMENT (4)

SPEAKER DEVICE

CROSS-REFERENCE TO RELATED APPLICATION

The present application claims priority from Japanese Patent Application No. JP 2010-155121 filed in the Japanese Patent Office on Jul. 7, 2010, the entire content of which is incorporated herein by reference.

FIELD

The present disclosure relates to a speaker device suitable for being applied to a speaker device capable of obtaining desired sound-image localization and a sense of extent.

BACKGROUND

A speaker system reproducing sound by adding vibration to an acoustic diaphragm by using a magnetostrictive actuator has been heretofore proposed (refer to JP-A-2007-166027 (Patent Document 1)).

As shown in FIG. 1, a cylindrical pipe 2 made of acrylic resin and so on is supported vertically on a disk-shaped base casing 3 and actuators 4 are arranged at four places of the base casing 3 at equal intervals in a speaker system 1.

In the speaker system 1, driving rods 4A of respective actuators 4 are allowed to abut on a lower end face of the pipe 2 and the actuators 4 are driven by an audio signal to add vibration to a vertical direction to the lower end face of the pipe 2.

At this time, the lower end face of the pipe 2 is excited by longitudinal waves. Elastic waves (vibration) is propagated in a surface direction (direction parallel to the surface) of the pipe 2 to be mixed waves in which longitudinal waves and transverse waves are mixed, and interaction of Poisson's ratio of the pipe 2 representing the relation between strain in an expansion and contraction direction of the elastic waves and strain orthogonal to the expansion and contraction direction can be obtained. As a result, vibration in an in-plane direction (direction vertical to the surface) is excited with uniform magnitude over the whole surface of the pipe 2 to emit sound waves, thereby forming a sound image with a uniform sense of extent over the whole pipe 2 in the height direction.

Patent Document 1 also shows that a normal speaker unit 6 is attached to an opening 5 at the center of the base casing 3 though omitted in the above speaker system 1.

In this case, the pipe 2 is configured to function as a tweeter taking charge of high-ranges of an audio frequency band and the normal speaker unit 6 is configured to function as a woofer taking charge of low-ranges of the audio frequency band.

SUMMARY

In the speaker system 1 described in Patent Document 1, the pipe 2 of the acoustic diaphragm made of a material having physical isotropy in which a physical constant is equal to all directions is used, therefore, propagation speed and propagation attenuation of elastic waves propagated in the in-plane direction of the pipe 2 are the same in all directions.

Here, a wave-front shape of sound waves emitted from the pipe 2 as the acoustic diaphragm depends on the diaphragm shape of the pipe 2, and there is a constraint that it is necessary to design an optional sound wave-front while considering the diaphragm shape of the pipe 2 in advance.

In view of the above, it is desirable to propose a speaker device having a simple structure capable of obtaining desired sound-image localization and the sense of extent not depending on only the diaphragm shape.

According to an embodiment of the present disclosure, there is provided a speaker device including an acoustic diaphragm having a given shape and made of a material having physical anisotropy and an excitation means attached to the acoustic diaphragm for exciting vibration components in consideration of a direction corresponding to the physical anisotropy. According to the structure, the vibration component can be excited in the direction corresponding to the physical anisotropy, therefore, a wave-front shape of sound waves emitted from the acoustic diaphragm and frequency characteristics in a sound-pressure level can be changed as compared with the case of using the acoustic diaphragm made of a material having physical isotropy.

According to the embodiment of the present disclosure, the vibration component can be excited in the direction corresponding to physical anisotropy, therefore, the wave-front shape of sound waves emitted from the acoustic diaphragm and frequency characteristics in the sound-pressure level can be changed as compared with the case of using the acoustic diaphragm made of a material having physical isotropy. As a result, the speaker device capable of obtaining desired sound-image localization and the sense of extent not depending on only the shape of the acoustic diaphragm.

DETAILED DESCRIPTION

Hereinafter, embodiments for carrying out the present technology will be explained. The explanation will be made in the following order.

1. Principle
2. First Embodiment
3. Second Embodiment
4. Other embodiments

<1. Principle>

In the present disclosure, the principle of intentionally using an acoustic diaphragm having physical anisotropy as a material will be explained.

Figure 1:
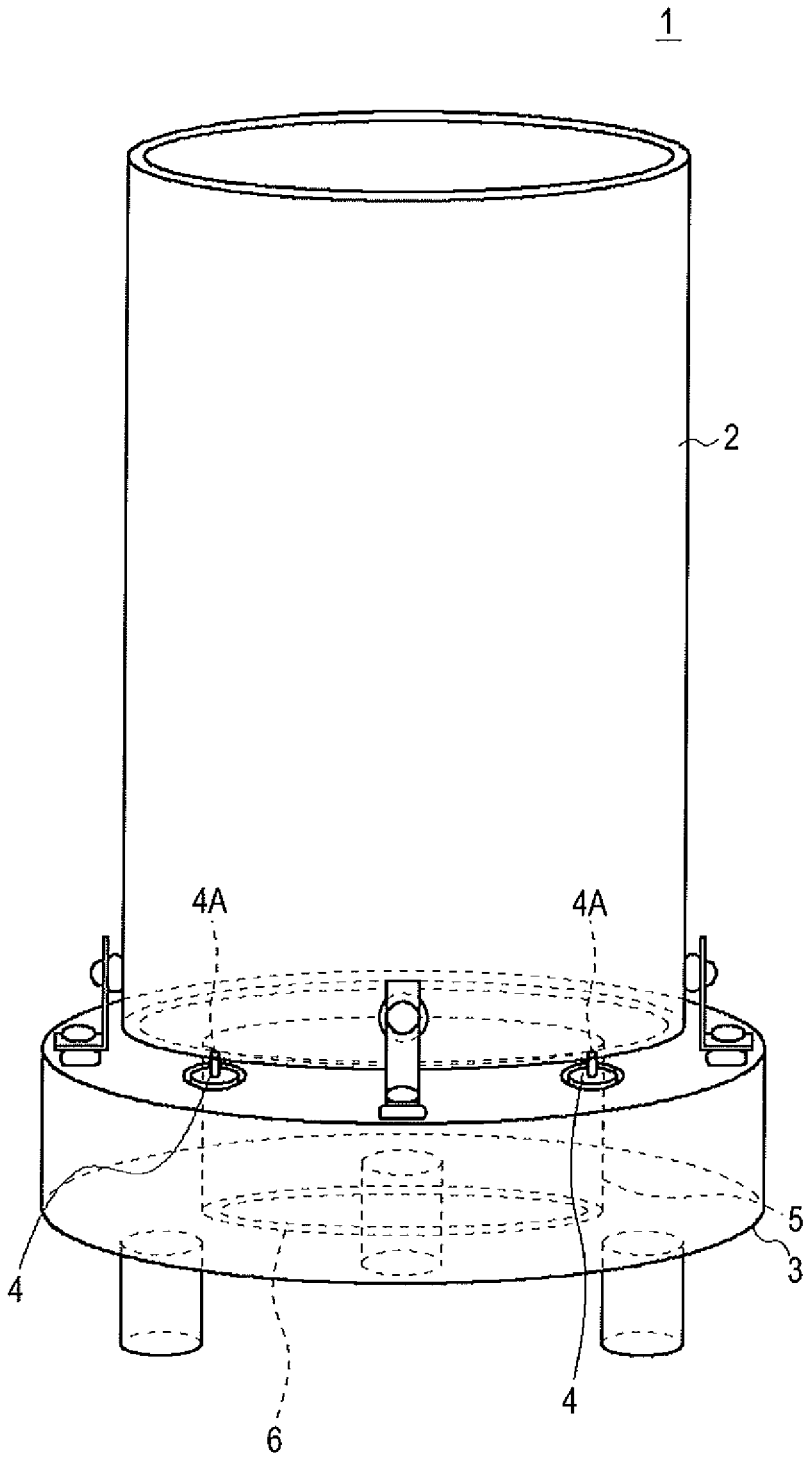
FIG. 1 is a schematic perspective view showing the entire structure of a related-art speaker device.
Figure 2:
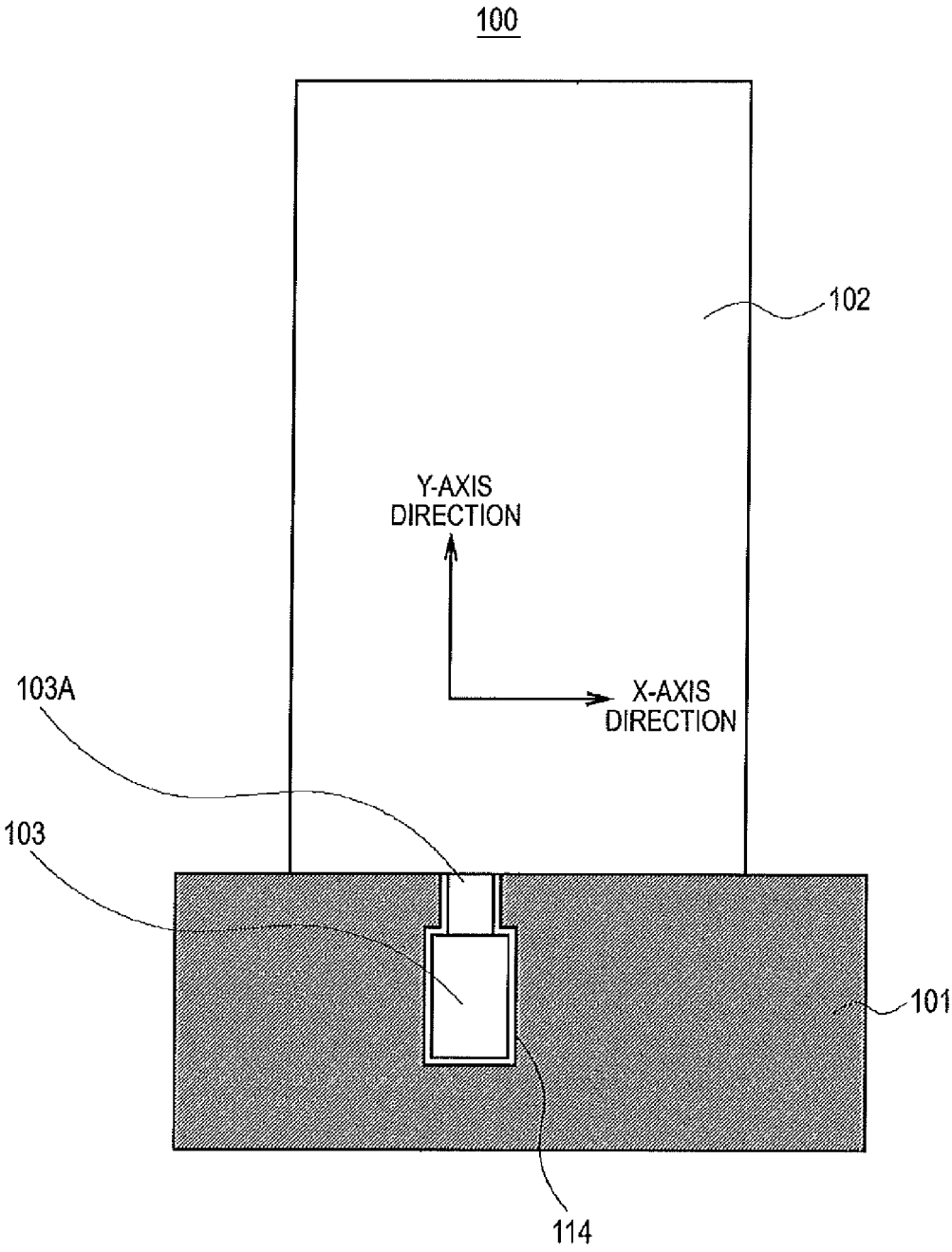
FIG. 2 is a schematic view showing a structure (1) of a speaker device using an acoustic diaphragm having physical anisotropy.

For example, a speaker device 100 includes a base casing 101, a plate-shaped acoustic diaphragm 102 having physical anisotropy and an actuator 103 exciting the acoustic diaphragm 102 as shown in FIG. 2.

In the speaker device 100, the actuator 103 is housed in a housing hole 114 of the base casing 101 to be fixed therein, and a driving rod 103A of the actuator 103 abuts on an end face on the lower end side of the acoustic diaphragm 102 having physical anisotropy.

It is also preferable that the driving rod 103A does not exist in the actuator 103 and that the acoustic diaphragm 102 having physical anisotropy is excited directly by the actuator 103.

At this time, a displacement direction of the driving rod 103A of the actuator 103 will be a direction orthogonal to the end face, namely, the Y-axis direction of the acoustic diaphragm 102 having physical anisotropy.

In the speaker device 100 having the above arrangement state, the acoustic diaphragm 102 having physical anisotropy is excited from the end face on the lower end side with a vibration component in the direction orthogonal to the end face by the actuator 103 to thereby excite elastic waves propagated in the direction of the vibration component.

Here, a physical material constant such as an elastic modulus or propagation loss of elastic waves in the Y-axis direction in the acoustic diaphragm 102 having physical anisotropy differs from the one in the X-axis direction in the acoustic diaphragm 102 having physical anisotropy.

Accordingly, the speaker device 100 is configured to obtain the sound-image localization and the sense of extent peculiar to the acoustic diaphragm 102 by using the acoustic diaphragm 102 having physical anisotropy.

FIG. 2 is an explanatory view for a case where elastic waves are propagated in the Y-axis direction of the acoustic diaphragm 102 having physical anisotropy. A speaker device using an acoustic diaphragm having physical anisotropy in a state in which the X-axis direction and the Y-axis direction of the acoustic diaphragm 102 (FIG. 2) are slightly rotated counterclockwise will be explained as follows.

Figure 3:
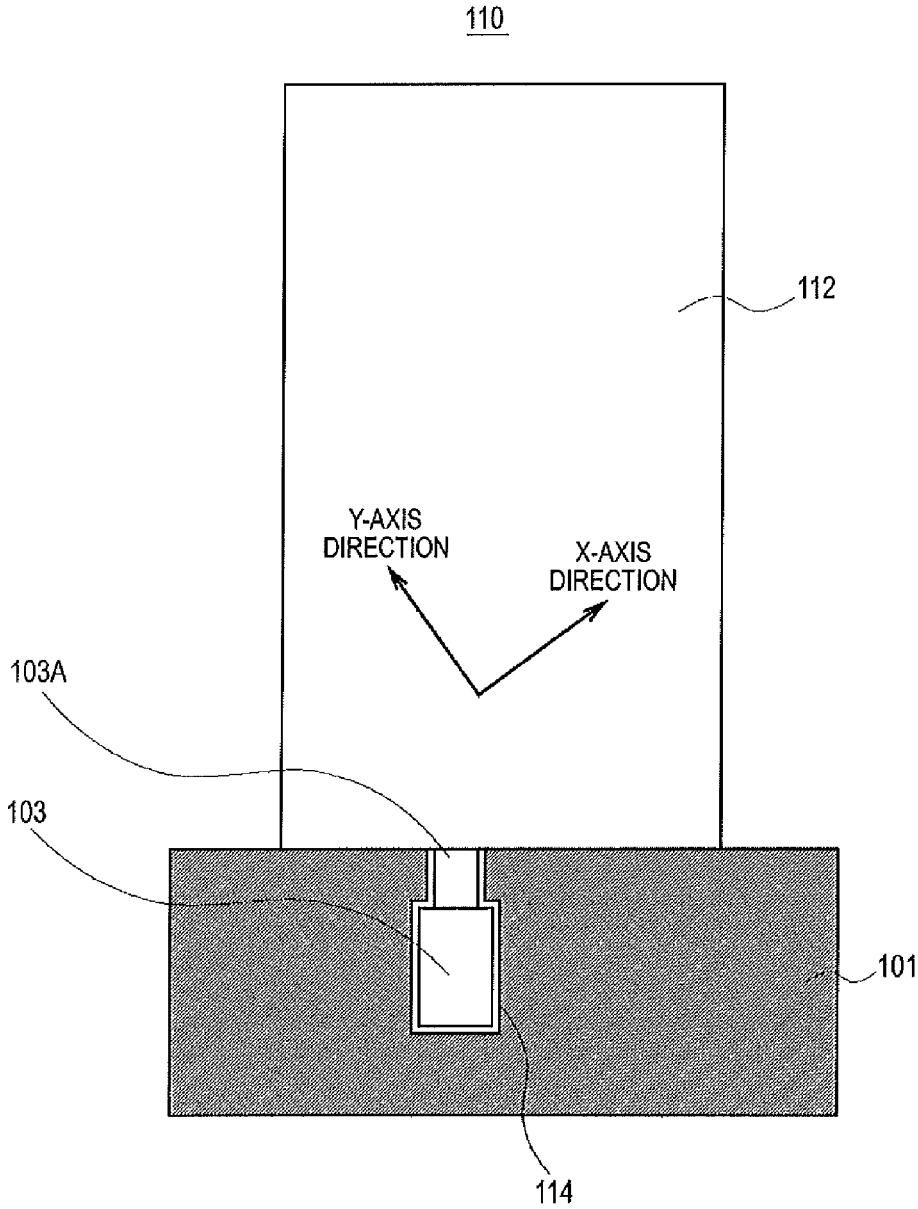
FIG. 3 is a schematic view showing a structure (2) of a speaker device using an acoustic diaphragm having physical anisotropy.

As shown in FIG. 3 in which the same codes are given to components corresponding to FIG. 2, a speaker device 110 includes the base casing 101, a plate-shaped acoustic diaphragm 112 having physical anisotropy and the actuator 103 exciting the acoustic diaphragm 112.

In the speaker device 110, the actuator 103 is housed in the housing hole 114 of the base casing 101 to be fixed therein, and the driving rod 103A of the actuator 103 abuts on an end face on the lower end side of the acoustic diaphragm 112 having physical anisotropy.

At this time, a displacement direction of the driving rod 103A of the actuator 103 will be the direction orthogonal to the end face, namely, an almost intermediate direction between the Y-axis direction and the X-axis direction of the acoustic diaphragm 102 having physical anisotropy.

In the speaker device 100 having the above arrangement state, the acoustic diaphragm 112 having physical anisotropy is excited from the end face on the lower end side with a vibration component in the direction orthogonal to the end face by the actuator 103 to thereby excite elastic waves propagated in the direction of the vibration component.

In this case, the acoustic diaphragm 112 in the speaker 110 (FIG. 3) is different in physical anisotropy from the acoustic diaphragm 102 in the speaker 100 (FIG. 2), therefore, the propagation speed and the propagation loss of elastic waves propagated in the in-plane direction of the acoustic diaphragm 112 varies as compared with the acoustic diaphragm 102 of the speaker device 100.

Accordingly, the speaker device 110 is configured to obtain the sound-image localization and the sense of extent peculiar to the acoustic diaphragm 112 by using the acoustic diaphragm 112 having physical anisotropy.

Figure 4:
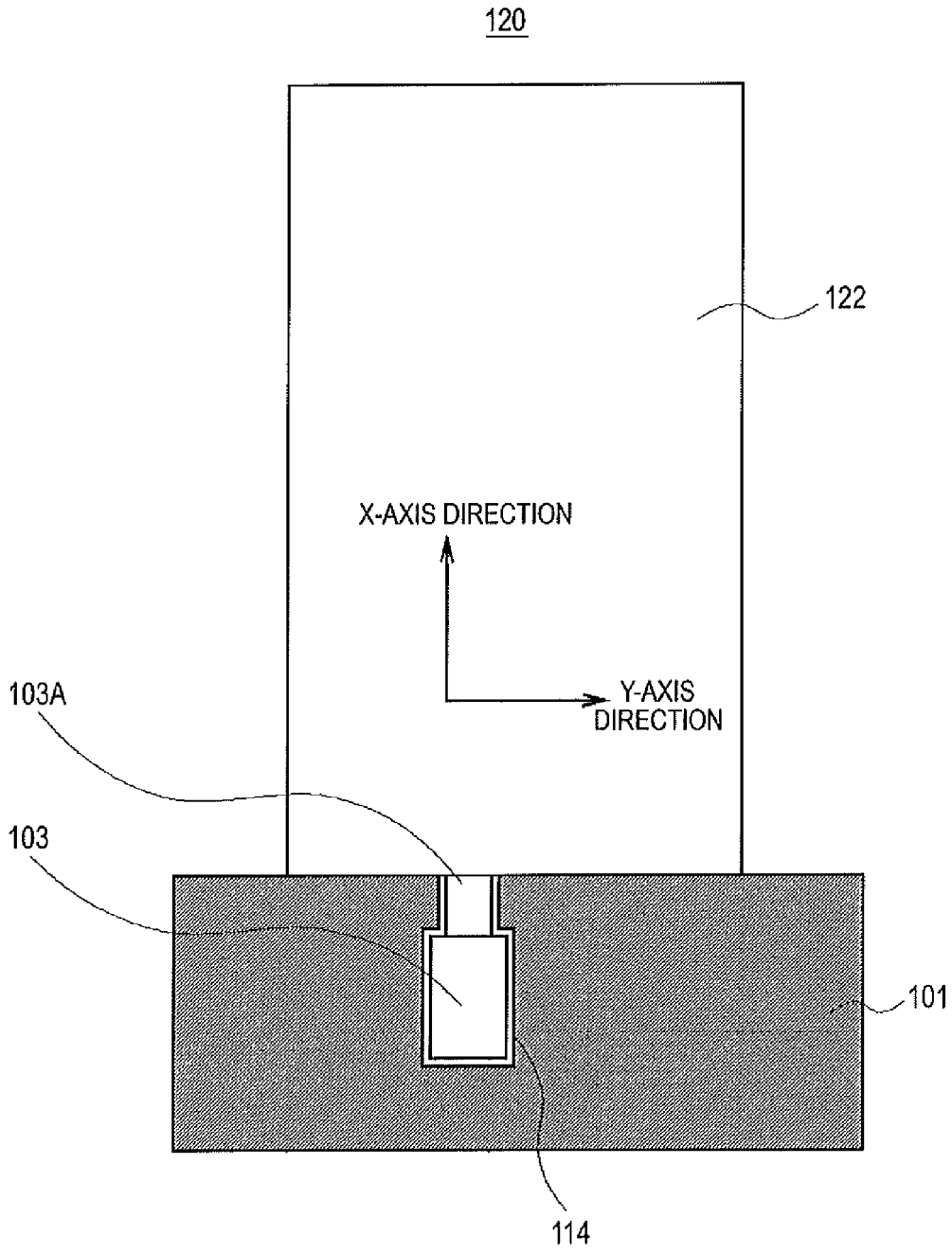
FIG. 4 is a schematic view showing a structure (3) of a speaker device using an acoustic diaphragm having physical anisotropy.

Moreover, as shown in FIG. 4 in which the same codes are given to components corresponding to FIG. 3, a speaker device 120 includes the base casing 101, a plate-shaped acoustic diaphragm 122 having physical anisotropy and the actuator 103 exciting the acoustic diaphragm 122.

In the speaker device 120, the actuator 103 is housed in the housing hole 114 of the base casing 101 to be fixed therein, and the driving rod 103A of the actuator 103 abuts on an end face on the lower end side of the acoustic diaphragm 122 having physical anisotropy.

At this time, a displacement direction of the driving rod 103A of the actuator 103 will be the direction orthogonal to the end face, namely, the X-axis direction of the acoustic diaphragm 122 having physical anisotropy, which is the direction rotated by 90 degrees as compared with the acoustic diaphragm 102 of the speaker device 100.

In the speaker device 120 having the above arrangement state, the acoustic diaphragm 122 having physical anisotropy is excited from the end face on the lower end side with a vibration component in the direction orthogonal to the end face by the actuator 103 to thereby excite elastic waves propagated in the direction of the vibration component.

Also in this case, the acoustic diaphragm 122 in the speaker 120 (FIG. 4) is 90 degrees different in physical anisotropy from the acoustic diaphragm 102 in the speaker 100 (FIG. 2), therefore, the propagation speed and the propagation loss of elastic waves propagated in the in-plane direction of the acoustic diaphragm 122 varies as compared with the acoustic diaphragm 102 of the speaker device 100.

Accordingly, the speaker device 120 is configured to obtain the sound-image localization and the sense of extent peculiar to the acoustic diaphragm 122 by using the acoustic diaphragm 122 having physical anisotropy.

Incidentally, assume that an elastic modulus in the X-axis direction is Ex, the elastic modulus in the Y-axis direction is Ey, a propagation loss modulus in the X-axis direction is Lx, the propagation loss modulus in the Y-axis direction is Ly in the acoustic diaphragms 102, 112 and 122 having physical anisotropy and that volume density of the acoustic diaphragm 102 is ρ, a propagation speed of elastic waves (in the case of longitudinal waves) propagating in the X-axis direction can be represented as $Vx=(Ex/\rho)^{1/2}$, and a propagation speed of elastic waves (in the case of longitudinal waves) propagating in the Y-axis direction can be represented as $Vy=(Ey/\rho)^{1/2}$.

The physical anisotropy is different by 90 degrees in the acoustic diaphragm 102 and the acoustic diaphragm 122, therefore, the propagation speed Vy in the acoustic diaphragm 102 largely differs from the propagation speed Vx in the acoustic diaphragm 122.

In the acoustic diaphragm 112 (FIG. 3), the Y-axis direction of the acoustic diaphragm 102 (FIG. 2) and the X-axis direction of the acoustic diaphragm 122 (FIG. 4) correspond to the intermediate direction between the Y-axis direction and the X-axis direction, and the propagation speed thereof will be an intermediate value of the propagation speed Vy and the propagation speed Vx.

As the propagation loss of elastic waves depends on the propagation direction as described above, it is obvious that the propagation loss of elastic waves varies according to the propagation direction.

In the speaker devices 100, 110 and 120, elastic waves are propagated in the in-plane direction of the acoustic diaphragms 102, 112 and 122 having physical anisotropy as well as sound waves are emitted into the air while exciting natural vibration modes in the in-plane direction (direction orthogonal to the surface) of the acoustic diaphragms 102, 112 and 122 through Poisson's ratio of the acoustic diaphragms 102, 112 and 122.

Therefore, when the propagation speed or the propagation loss of elastic waves varies according to the acoustic diaphragms 102, 112 and 122 having physical anisotropy, the wave-front of sound waves emitted in the air varies in the speaker devices 100, 110 and 120.

That is, the speaker devices 100, 110 and 120 are configured to emit sound waves having wave-front shapes different from one another from the acoustic diaphragms 102, 112 and 122 by using the acoustic diaphragms 102, 112 and 122 having physical anisotropies different from one another, though the shape of the acoustic diaphragms 102, 112 and 122 is the same plate shape.

Figure 5:
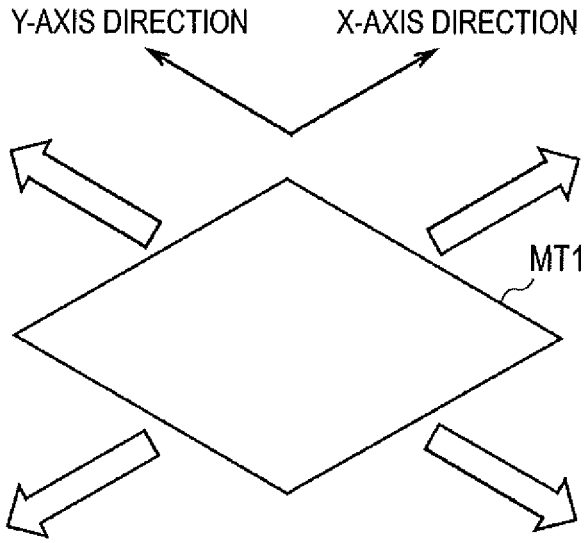
FIG. 5 is a schematic view for explaining a method (1) of giving physical anisotropy.

There is a method of adding different forces in the X-axis direction and the Y-axis direction when forming an acoustic diaphragm material MT1 in a sheet state in order to give the physical anisotropy to the diaphragm material as shown in FIG. 5.

Figure 6:
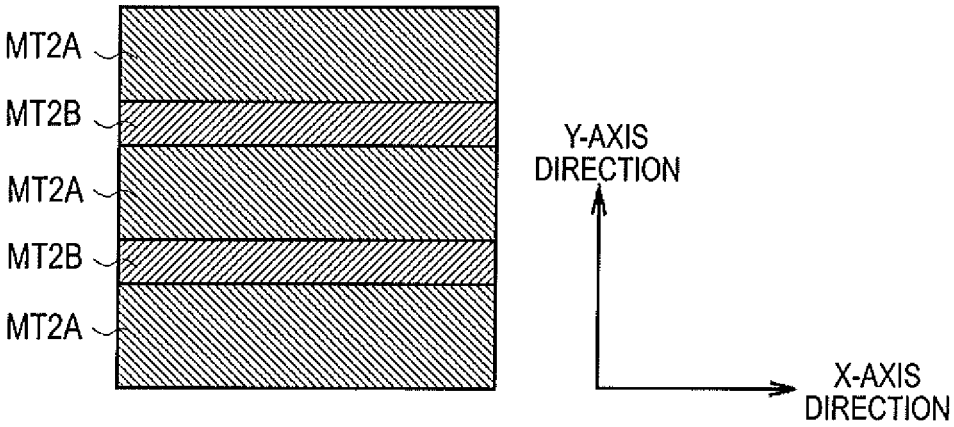
FIG. 6 is a schematic view for explaining a method (2) of giving physical anisotropy.

There is also a method of alternately stacking two types of acoustic diaphragm materials MT2A, MT2B having different physical anisotropies as shown in FIG. 6. In this case, the staking manner is not limited to this and it is also preferable that three pieces of the acoustic diaphragm materials MT2A are staked and two pieces of the acoustic diaphragm materials MT2B are stacked thereon or therebelow, or that the five pieces of same acoustic diaphragm materials MT2A or MT2B are stacked.

Furthermore, a method of forming the diaphragms in consideration of the growth ring direction of wood, and other various types of methods can be used as long as physical anisotropy can appear.

Figure 7A:
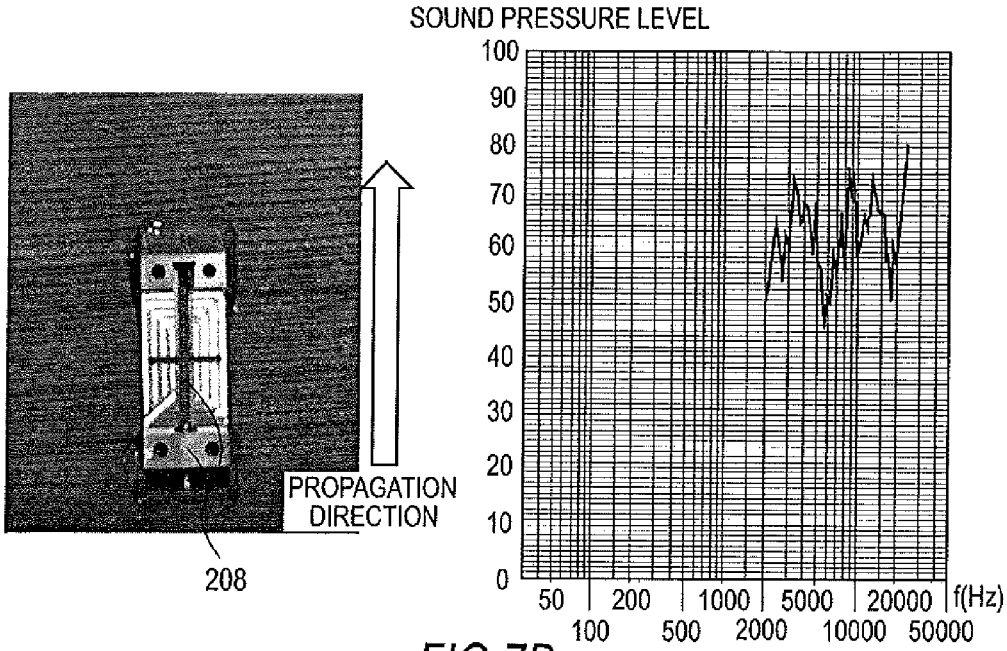
FIGS. 7A and 7B are schematic views showing driving directions and frequency characteristics with respect to wood.
Figure 7B:
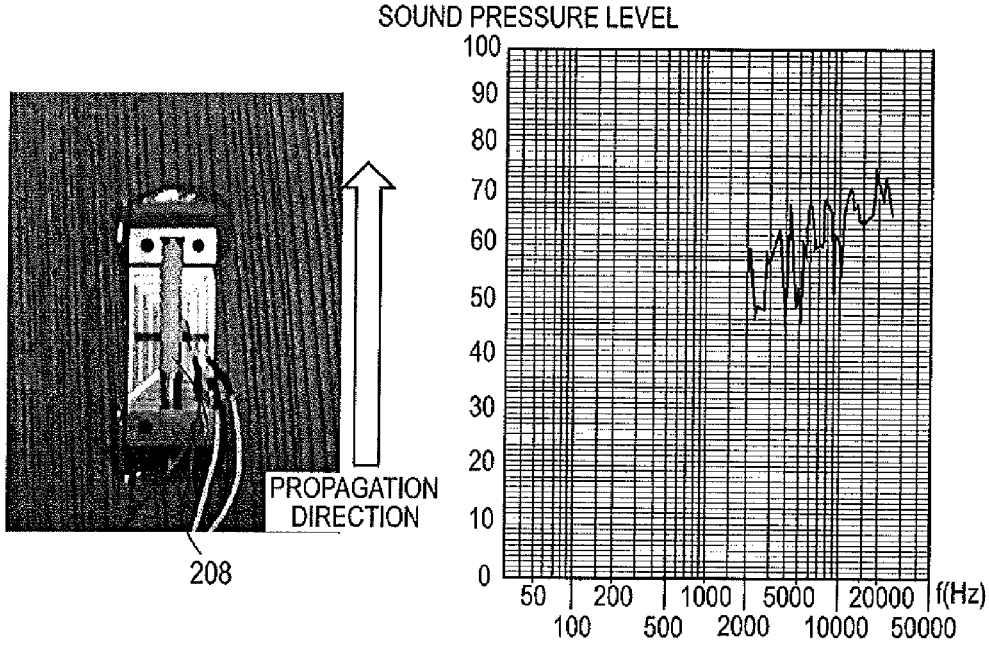

As shown in FIGS. 7A and 7B, when wood is used as the acoustic diaphragm, it is confirmed that frequency characteristics in a sound pressure level differ in the case where the propagation direction of elastic waves propagated in the in-plane direction by an actuator 208 is set as a direction orthogonal to a straight grain (FIG. 7A) and in the case where the direction is set as a direction parallel to the straight grain (FIG. 7B).

In this case, the propagation speed of elastic waves is low and the propagation loss is large in the direction orthogonal to the straight grain (FIG. 7A), whereas in the direction parallel to the straight grain (FIG. 7B), the propagation speed of elastic waves is high and the propagation loss is small. The propagation speed is determined by the volume density of the material of the acoustic diaphragm and the hardness in the propagation direction (Young's modulus).

Concerning the propagation loss, elastic waves are reflected as materials (acoustic impedance) differ before and after a boundary of grains in the case of the direction orthogonal to the straight grain (FIG. 7A), which increases the loss and reduces the propagation ratio. Whereas, in the case of the straight grain direction (FIG. 7B), elastic waves are propagated through the acoustic diaphragm at approximately the same speed.

That is, it is found that the propagation speed and the propagation loss vary and frequency characteristics in the sound pressure level also differ in the case of aligning the propagation direction of the vibration component by the actuator 208 so as to be along the straight grain direction and in the case of aligning the propagation direction of the vibration component by the actuator 208 so as to be along the direction orthogonal to the straight grain direction even in the same acoustic diaphragm.

The above is the principle of using the acoustic diaphragm 102, 112 or 122 made of wood having physical anisotropy from the first.

Though the plate-shaped acoustic diaphragms 102, 112 and 122 are explained as examples in this case, however, other various shapes can be used as the shape of the acoustic diaphragms 102, 112 and 122 such as a tubular shape and a spherical shape.

In the speaker devices 100, 110 and 120, the actuator 103 is set so as to abut on the end face on the lower end side of the acoustic diaphragms 102, 112 and 122. However, it is not limited to this, and it is also preferable that a through hole is provided in the acoustic diaphragms 102, 112 and 122 and the actuator 103 is set so as to abut on a cross section of the position. It is further preferable that a groove is provided in the acoustic diaphragms 102, 112 and 122 and the actuator 103 is set so as to excite the cross section of the groove.

<2. First Embodiment>

Next, a speaker device 200 in the first embodiment using the above principle will be specifically explained.

[2-1. Appearance Structure of the Speaker Device]

Figure 8:
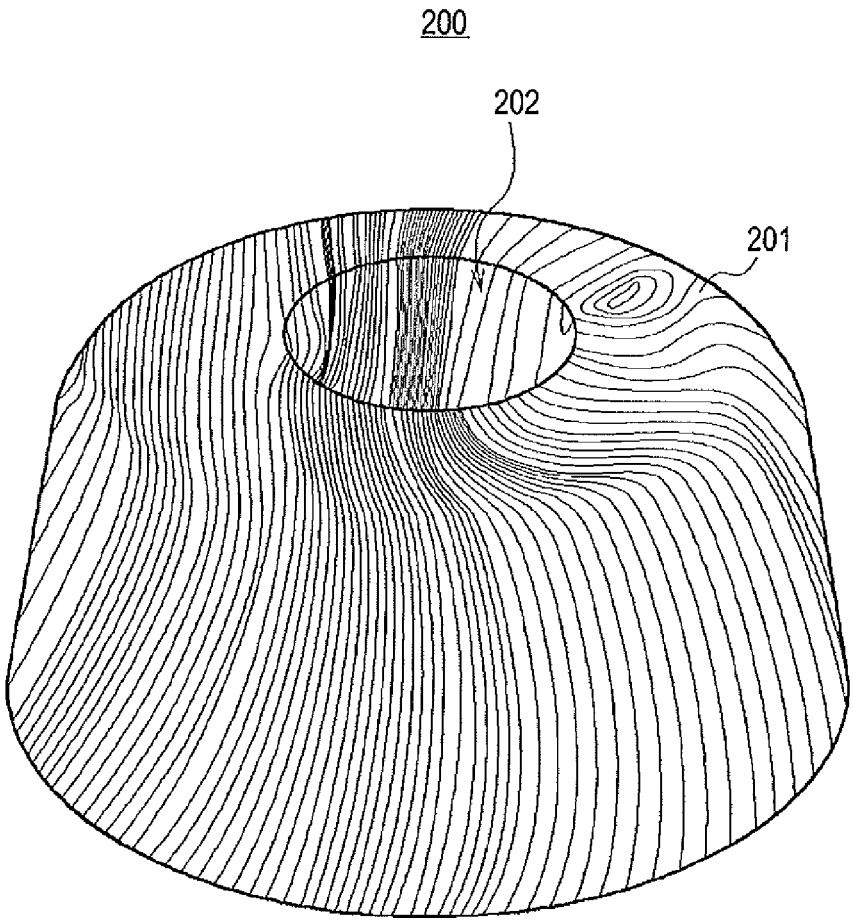
FIG. 8 is a schematic perspective view showing an appearance structure of a speaker device according to a first embodiment.

As shown in FIG. 8, the speaker device 200 has an acoustic diaphragm 201 having a conical trapezoid shape on the whole with an internal space formed therein, and a through hole 202 is formed from the top to the bottom of the acoustic diaphragm 201 so as to pierce through the center.

The speaker device 200 includes the acoustic diaphragm 201 made of wood, which is formed so that the straight grain direction is approximately vertical direction in the drawing.

The acoustic diaphragm 201 of the speaker device 200 is manufactured by being cut from a piece of wood, however, it is also possible to manufacture the diaphragm by being cut from plural wood blocks which are adhered so that wood grains are aligned.

Figure 9A:
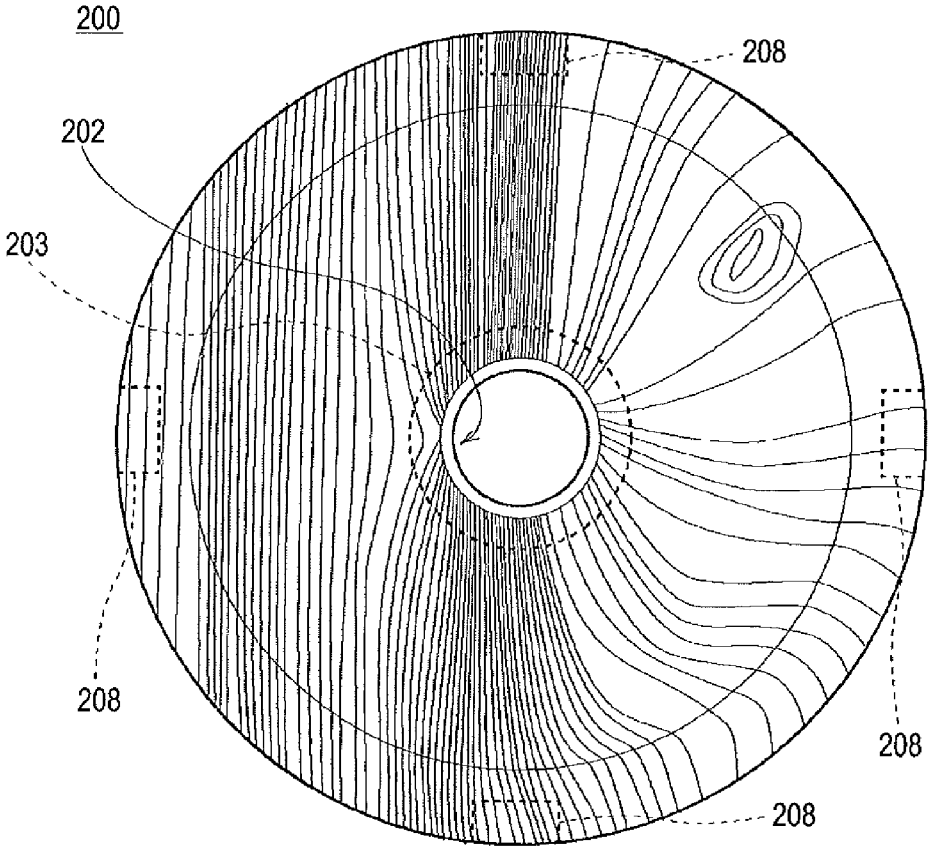
FIGS. 9A and 9B are schematic diagrams showing upper-surface and side-surface structures of the speaker device according to the first embodiment.
Figure 9B:
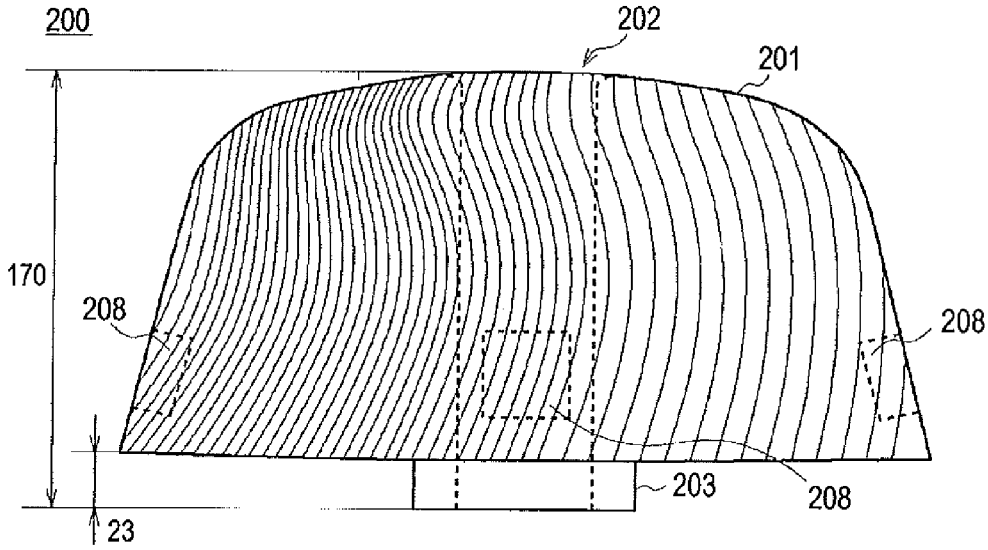

As shown in FIGS. 9A and 9B, the speaker device 200 is provided with a pipe-shaped leg portion 203 having a given diameter on the same axis as the through hole 202, having a structure in which the leg portion 203 is integrally formed with the acoustic diaphragm 201 having the conical trapezoid shape.

The leg portion 203 protrudes downward from the lower end face of the acoustic diaphragm 201 by approximately 23 mm, which is formed so that the lower end face of the acoustic diaphragm 201 does not touch a setting surface of the floor, for example, when set on the floor. The speaker device 200 has a height of approximately 170 mm measured from the setting surface of the floor to the upper surface of the acoustic diaphragm 201.

Figure 10:
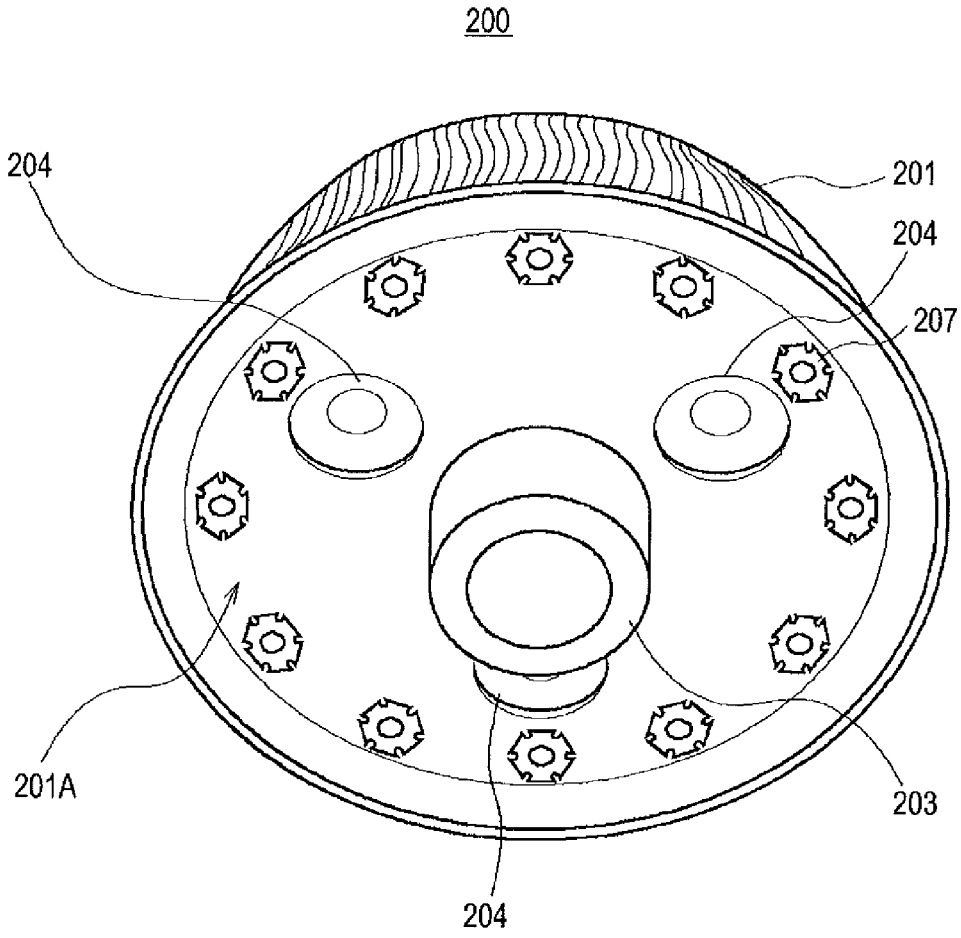
FIG. 10 is a schematic perspective view showing a bottom surface structure of the speaker device according to the first embodiment.

Further, as shown in FIG. 10, the speaker device 200 has a structure in which a lower end of the acoustic diaphragm 201 is closed by a donut-shaped plate 201A made of resin and so on, in which a total of three speaker units 204 for low-middle frequency sound are arranged in a ring state at intervals of 120 degrees on the circumference of the plate 201A about the leg portion 203 protruding from the plate 201A.

In this case, the lower end face of the acoustic diaphragm 201 does not touch the setting surface of the floor when set on the floor through the leg portion 203 in the speaker device 200 as described above, therefore, sound waves emitted from the three speaker units 204 are not interrupted by the setting surface and are emitted to the outside as low-middle frequency sound.

Additionally, the speaker device 200 is provided with a total of twelve LED devices 207 arranged in a ring state at intervals of 30 degrees on the outer circumference of the plate 201A attached to the lower end of the acoustic diaphragm 201.

Also in this case, the lower end face of the acoustic diaphragm 201 does not touch the setting surface of the floor when set on the floor through the leg portion 203 in the speaker device 200 as described above, therefore, irradiated light from the twelve LED devices 207 are not interrupted by the setting surface of the floor and light is irradiated to the setting surface as well as to outer areas in the vicinity of the setting surface.

[2-2. Cross-Sectional Structure of the Speaker Device]

Figure 11:
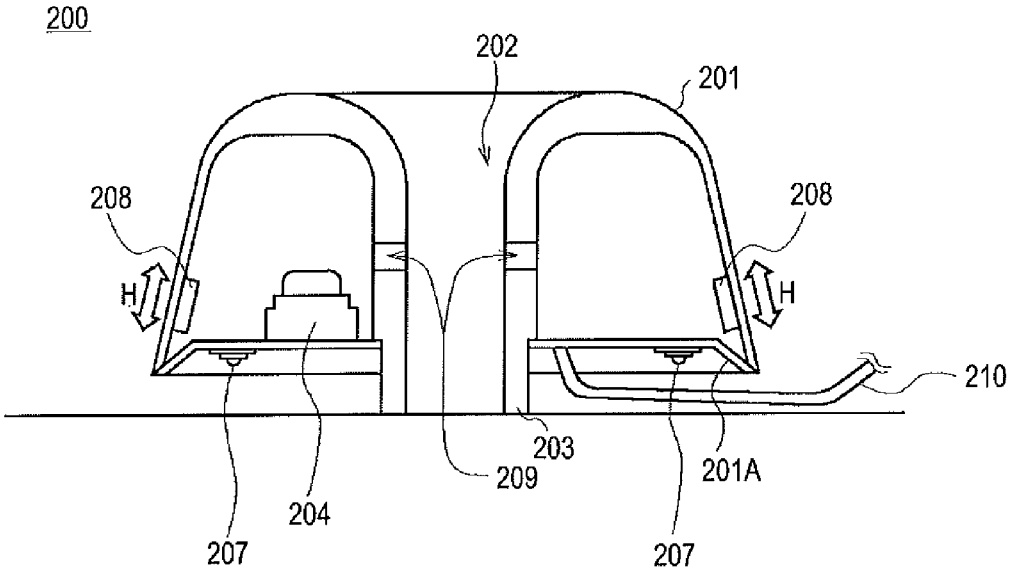
FIG. 11 is a schematic perspective view showing a cross-sectional structure of the speaker device according to the first embodiment.

As shown in FIG. 11, the speaker device 200 has the structure in which the speaker units 204 provided in the inner space of the acoustic diaphragm 201 having the conical trapezoid shape are attached to the reverse-surface side of the plate 201A and diaphragm portions of the speaker units 204 are exposed from the surface side of the plate 201A.

In this case, the lower end of the acoustic diaphragm 201 of the speaker device 200 is closed by the plate 201A, the acoustic diaphragm 201 and the plate 201A function as an enclosure with respect to the speaker units 204 attached to the plate 201A.

In the speaker device 200, ducts 209 having a given diameter are provided on a side wall integrally formed with the leg portion 203 of the acoustic diaphragm 201 in a state of connecting to the through hole 202 as well as facing each other at a total of two positions. The ducts 209 and the through hole 202 form a bass reflex port by the structure. When sufficient volume is provided in the acoustic diaphragm 201, it is not always necessary to provide the duct 209 and a sealed structure can be applied.

Also in the speaker device 200, a total of four actuators 208 for exciting a side wall in a direction of arrows H are attached at lower parts of the side wall on the outer circumference side of the acoustic diaphragm 201 in a ring state at intervals of 90 degrees in a state of being concealed inside the acoustic diaphragm 201.

In this case, the displacement by the actuators 208 is directed from below to above of the acoustic diaphragm 201 (in-plane direction), and the acoustic diaphragm 101 can be excited by the four actuators 208.

Here, as the actuator 208, for example, a piezoelectric actuator, a magnetostrictive actuator and a dynamic actuator are used.

At this time, in the speaker device 200, the lower part of the side wall on the outer circumference side of the acoustic diaphragm 201 is excited by longitudinal waves and the vibration elastic waves are propagated in the direction from below to above of the acoustic diaphragm 201 (straight grain direction) and emitted to the acoustic diaphragm 201 as mixed waves in which longitudinal waves and transverse waves are mixed, as a result, the sound image uniform over the whole of the acoustic diaphragm 201 in the height direction is formed.

Accordingly, the acoustic diaphragm 201 forms a speaker taking charge of high-ranges of an audio frequency band to function as a tweeter as well as the speaker unit 204 forms a speaker taking charge of middle to low ranges of the audio frequency band to function as a woofer in the speaker unit 200.

Figure 12:
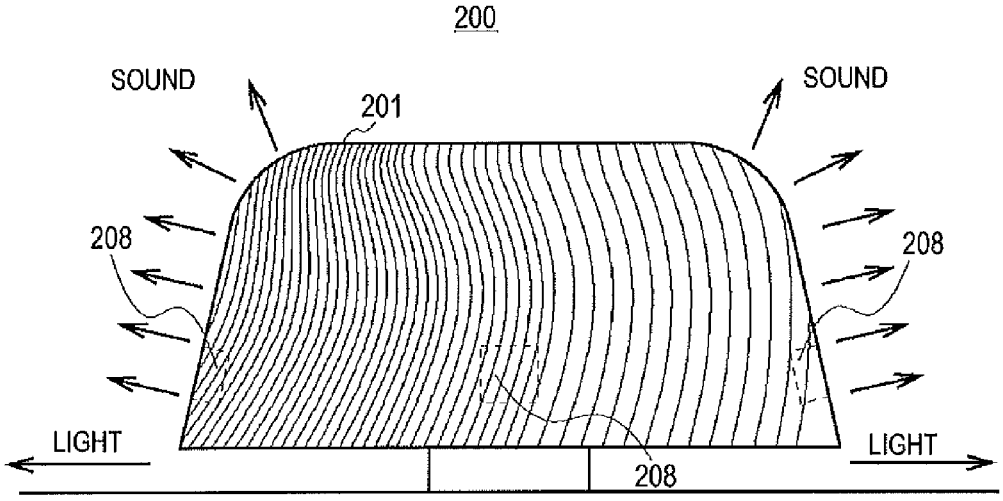
FIG. 12 is a schematic view showing a straight grain direction and an excitation direction of actuators according to the first embodiment.

Incidentally, the speaker device 200 is provided with four actuators 208 in the ring state at intervals of 90 degrees so that the excitation direction corresponds to the straight grain direction of the acoustic diaphragm 201 as shown in FIG. 12.

Here, the four actuators 208 are driven by individual four types of audio signals and excite the acoustic diaphragm 201 by vibration components in the direction of arrows H with respect to the side wall on the outer circumference side of the acoustic diaphragm 201. At this time, respective vibration components in accordance with four types of audio signals are propagated along the straight grain direction efficiently and are difficult to be propagated in the direction orthogonal to the straight grain direction.

That is, the speaker device 200 is provided with four actuators 208 which are attached so that the excitation direction corresponds to the straight grain direction of the acoustic diaphragm 201, therefore, mixture of respective vibration components by the four actuators 208 can be avoided and crosstalk can be drastically reduced.

Incidentally, a code 210 for inputting four types of audio signals from the outside and supplying the signals to four actuators 208 and three speaker units 204 is connected to the speaker 200 (FIG. 11), which is assumed to be used in a state of, for example, being attached to a wall and the like through the leg portion 203.

The speaker device 200 houses a not-shown power supply battery and an amplifier inside the acoustic diaphragm 201, allowing the speaker device 200 to function as an active speaker. However, it is not always necessary that the power supply battery, the amplifier and the like are housed, and that the speaker device 200 may function only as a passive speaker not including the power supply battery, the amplifier and the like.

[2-3. Frequency Characteristics in the Sound Pressure Level Due to the Difference of Materials]

Next, effects of difference of physical anisotropy due to materials will be verified concerning frequency characteristics in the sound pressure level when exciting the pipe-shaped acoustic diaphragm using, for example, resin such as acrylic having isotropy as a material and frequency characteristics in the sound pressure level when exciting the pipe-shaped acoustic diaphragm using wood having physical anisotropy as a material.

Here, specific explanation will be made through experiment results verified by using the pipe-shaped acoustic diaphragm, not the conical-trapezoid shaped acoustic diaphragm.

Figure 13A:
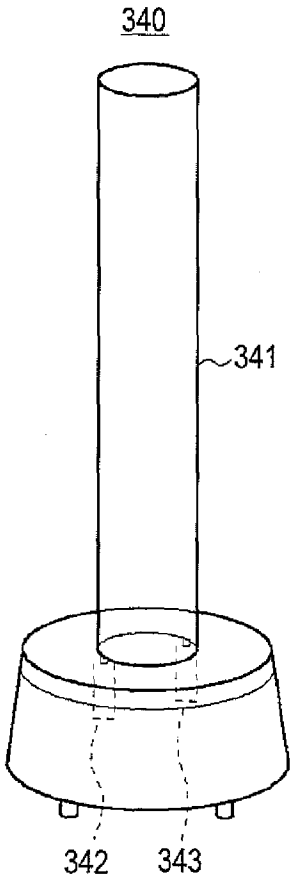
FIGS. 13A and 13B are schematic views showing frequency characteristics in a pressure level when using acrylic as the acoustic diaphragm.
Figure 13B:
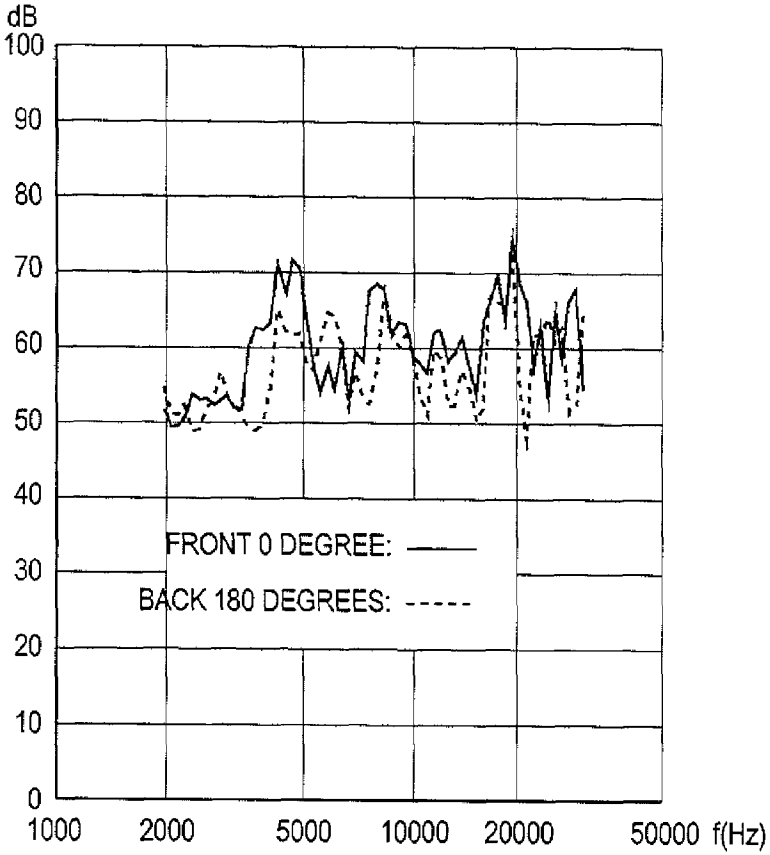

FIGS. 13A and 13B show sound-pressure levels obtained when two points on the front side and the back side in a pipe-shaped acoustic diaphragm 341 using resin such as acrylic as a material are excited by two actuators 342, 343 from the lower end face toward the vertical direction in a speaker device 340.

Figure 14A:
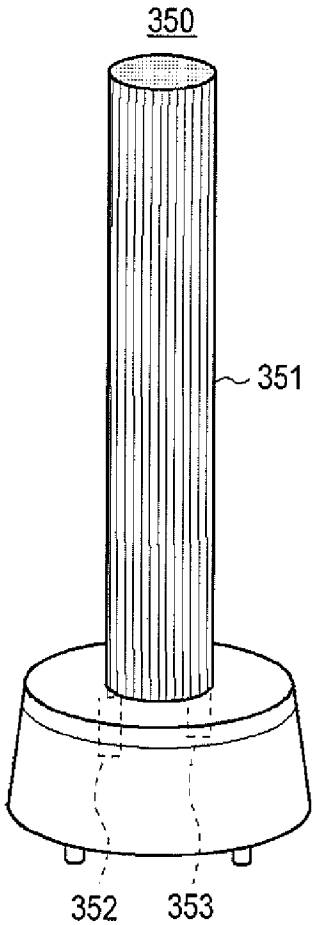
FIGS. 14A and 14B are schematic views showing frequency characteristics in the pressure level when using wood as the acoustic diaphragm.
Figure 14B:
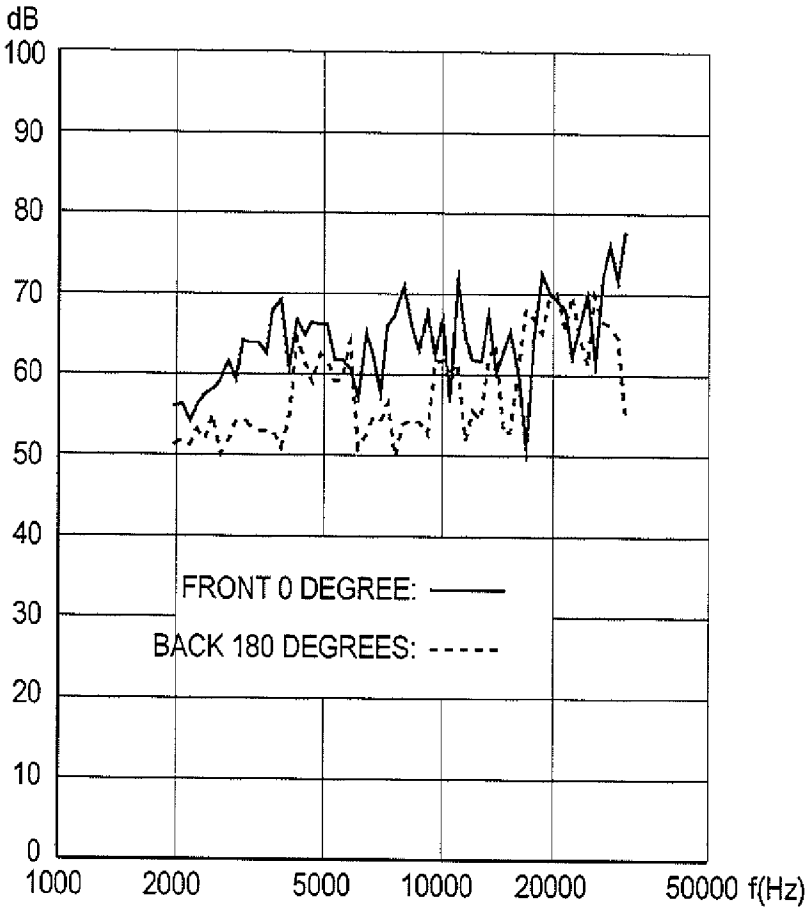

On the other hand, FIGS. 14A and 14B show sound-pressure levels obtained when two points on the front side and the back side in a pipe-shaped acoustic diaphragm 351 using wood as a material are excited by two actuators 352, 353 from the lower end face toward the vertical direction in a speaker device 350.

When comparing both cases, it can be found that the speaker device 350 (FIG. 14A) having the acoustic diaphragm 351 using wood as the material has a smaller peak dip (solid line) on the front side as compared with the speaker device 340 (FIG. 13A) having the acoustic diaphragm 341 using the resin such as acrylic as the material.

Additionally, it can be found that the speaker device 350 (FIG. 14A) having the acoustic diaphragm 351 using wood as the material has a smaller diffraction of vibration components from the front side to the back side as compared with the speaker device 340 including the acoustic diaphragm 341 using the resin such as acrylic as the material (it is conceivable that the diffraction of vibration components is smaller as the difference of sound pressure levels between the front side and the back side is larger). This is because the vibration propagation attenuation in the circumferential direction becomes larger by the straight grains of wood in the acoustic diaphragm 351.

As can be seen from the result, the vibration propagation attenuation in the circumferential direction becomes larger due to the straight grains as well as diffraction of vibration components from the front side to the back side becomes smaller in the case of using the acoustic diaphragm 351 (FIG. 14A) using wood of straight grains as the material having physical anisotropy as compared with the case of using the acoustic diaphragm 341 (FIG. 13A) using resin such as acrylic as the material having isotropy, therefore, crosstalk can be drastically reduced.

[2-4 Configuration of a Driving System of the Speaker Device]

Figure 15:
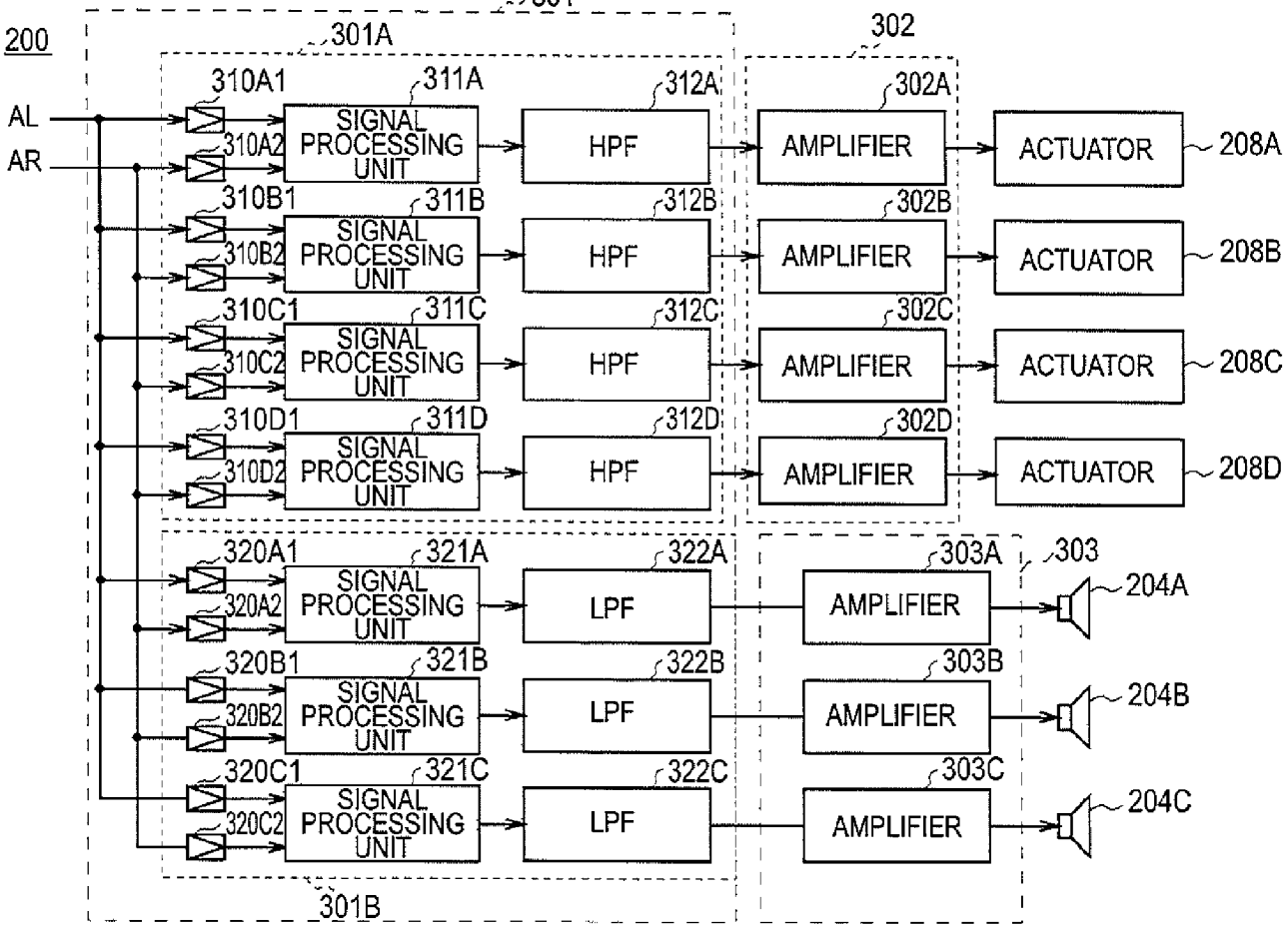
FIG. 15 is a schematic block diagram showing a configuration of a driving system of the speaker device according to the first embodiment.

Next, a driving system of the speaker device 200 will be explained. As shown in FIG. 15, the speaker device 200 largely includes a DSP block 301 and amplifier blocks 302, 303.

The DSP block 301 includes a signal correction and sound-field control unit 301A on the actuators 208 (208A to 208D) side and a signal correction and sound-field control unit 301B on the speaker units 204 (204A to 204C) side.

The signal correction and sound-field control unit 301A on the actuators 208 side includes four signal processing unit 311 (311A to 311D) and four high-pass filters 312 (312A to 312D) so as to correspond to four actuators 208 (208A to 208D).

The signal correction and sound-field control unit 301A further includes eight attenuators (310A1, 310A2, 310B1, 310B2, . . . , 310D1, 310D2) for attenuating and inputting a left audio signal AL and a right audio signal AR forming a stereo audio signal into the four signal processing units 311 (311A to 311D) respectively.

Respective signal processing units 311 (311A to 311D) perform adjustment of signal levels, delay time, frequency characteristics and so on of the left-audio signal AL and the right audio signal AR inputted respectively, and further performs mixture processing (sound-field control processing) with respect to the left-audio signal AL and the right-audio signal AR as well as signal correction processing concerning output characteristics of the actuators 208 (208A to 208D).

Individual high-pass filters 312 (312A to 312D) respectively extract high-frequency components of the audio signals supplied from the signal processing units 311 (311A to 311D) and supply the components to respective amplifiers 302A to 302D of the amplifier block 302.

In this case, high-frequency components of audio signals obtained as a result of the sound-field control processing and the signal correction processing individually performed by the signal correction and the sound-field control unit 301A in the DSP block 301 are supplied to the four actuators 208 (208A to 208D) after being amplified by the amplifier block 302.

According to the above, the speaker device 200 can increase the sense of extent of sound due to high-frequency audio output by the four actuators 208 (208A to 208D) which are driven by high-frequency components to which the sound-field control processing is performed individually.

On the other hand, the signal correction and sound-field control unit 301B on the speaker unit 204 includes signal processing units 321A to 321C and low-pass filters 322A to 322C so as to correspond to the speaker units 204A to 204C.

The signal correction and sound-field control unit 301B further includes attenuators 320A1, 320A2, 320B1, 320B2, 320C1 and 320C2 for attenuating and inputting a left audio signal AL and a right audio signal AR forming a stereo audio signal into the signal processing units 321A to 321C respectively.

Respective signal processing units 321A to 321C performs adjustment of signal levels, delay time, frequency characteristics and so on of the left-audio signal AL and the right audio signal AR, and further performs mixture processing (sound-field control processing) with respect to the left-audio signal AL and the right-audio signal AR as well as signal correction processing concerning resonance tube characteristics. The low-pass filters 322A to 322C extract low-frequency components of the audio signals supplied from the signal processing units 321A to 321C and supply the components to respective amplifiers 303A to 303C.

In this case, low-frequency components of audio signals obtained as a result of the sound-field control processing and the signal correction processing performed by the signal correction and the sound-field control unit 301B in the DSP block 301 are supplied to the speaker units 204A to 204C after being amplified by the amplifiers 303A to 303C.

According to the above, the speaker device 200 can increase the sense of extent of sound due to low-frequency audio output by the speaker units 204A to 204C which are driven by low-frequency components to which the sound-field control processing is performed individually.

The positions of the signal processing units 311 (311A to 311D) and the high-pass filters 312 (312A to 312D) in the signal correction and sound-field control unit 301A can be reversed as well as positions of the signal processing units 321 (321A to 321C) and the low-pass filters 322 (322A to 322C) in the signal correction and sound-field control unit 301B can be also reversed.

[2-5. Operation of the Speaker Device]

Subsequently, operation of the speaker device 200 (FIG. 8 to FIG. 12) will be explained.

In the speaker device 200, the four actuators 208 (208A to 208D) provided inside the acoustic diaphragm 201 is driven by the left-audio signal AL and the right-audio signal AR and excite the acoustic diaphragm 201 by the vibration components in the direction of arrows H (FIG. 11) from below to above of the acoustic diaphragm 201.

At this time, the acoustic diaphragm 201 is excited by longitudinal waves and elastic waves (vibration) are propagated through the acoustic diaphragm 201 in the direction from below to above (in-plane direction). Then, when the elastic waves are propagated in the acoustic diaphragm 201, mode conversion of longitudinal waves, transverse waves, longitudinal waves . . . is repeated to be mixed waves of longitudinal waves and transverse waves. Vibrations in the in-plane direction (direction vertical to the surface) of the acoustic diaphragm 201 are excited by the transverse waves.

According to the above, the speaker device 200 emits sound waves from the surface of the acoustic diaphragm 201. That is, the speaker device 200 can obtain high-frequency audio output from the outer surface of the acoustic diaphragm 201.

The speaker device 200 can also obtain middle-low frequency audio output from the three speaker units 204 attached on the plate 201A as the lower end face of the acoustic diaphragm 201 does not touch the setting surface of the floor due to the leg portion 203 as well as can increase the low-frequency range as the bass reflex port is formed by the ducts 209 and the through hole 202.

[2-6. Illumination Effects in the Speaker Device]

The speaker device 200 (FIG. 12) can obtain illumination effects which allows light to leak out around the acoustic diaphragm 201 to be brightened by irradiating the lower part of the acoustic diaphragm 201 with irradiated light from the total of twelve LED devices 207 attached to the plate 201A.

As the speaker device 200 has a structure in which it does not look like the speaker in appearance, therefore, the speaker device 200 can be used not only as the audio output means but also as a decorative illumination means such as a bedside lamp or indirect lighting of a room.

[2-7 Operation and Effect]

In the above structure, the speaker device 200 includes four actuators 208 attached so as to allow the excitation direction to correspond to the straight grain direction of the acoustic diaphragm 201 formed so that grains are vertical by using anisotropy of the acoustic diaphragm 201 having the conical trapezoid shape.

According to the structure, the speaker device 200 adds not only the shape of the acoustic diaphragm 201 but also the propagation direction of sound waves by the anisotropy of the acoustic diaphragm 201 as parameters for changing the wave-front shape of sound waves emitted from the acoustic diaphragm 201 and frequency characteristics in the sound pressure level, which can extend a controllable area of sound-image localization and the sense of extent.

The speaker device 200 also drives four actuators 208 by independent four types of audio signals to excite the acoustic diaphragm 201 by vibration components in the direction of arrows H with respect to the side wall on the outer circumference side of the acoustic diaphragm 201.

According to the above structure, respective vibration components corresponding to four-types of audio signals are propagated along the straight grain direction of the acoustic diaphragm 201 efficiently, and sound images uniform over the whole acoustic diaphragm 201 in the height direction can be formed in the speaker device 200.

Furthermore, four actuators 208 are attached so that the excitation direction corresponds to the straight grain direction of the acoustic diaphragm 201 in the speaker device 200, therefore, propagation loss in the direction orthogonal to the straight grain is large in respective vibration components by the four actuators 208 and mixture of the vibration components can be avoided, as a result, crosstalk can be previously prevented to obtain good acoustic characteristics.

The speaker device 200 also allows light to leak out around the acoustic diaphragm 201 to be brightened by irradiated light from the total of twelve LED devices 207 attached to the plate 201A.

According to the structure, the speaker device 200 can function as the audio output means capable of obtaining good acoustic characteristics while preventing the crosstalk as well as can function as the decorative illumination means.

According to the above configuration, the speaker device 200 is provided with four actuators 208 so as to allow the excitation direction to correspond to the straight grain direction of the acoustic diaphragm 201 by using anisotropy of the acoustic diaphragm 201 having the conical trapezoid shape formed so that the wood grains are vertical to thereby prevent crosstalk previously due to mixture of respective vibration components by the four actuators 208 and obtain good acoustic characteristics.

<3. Second Embodiment>

Figure 16:
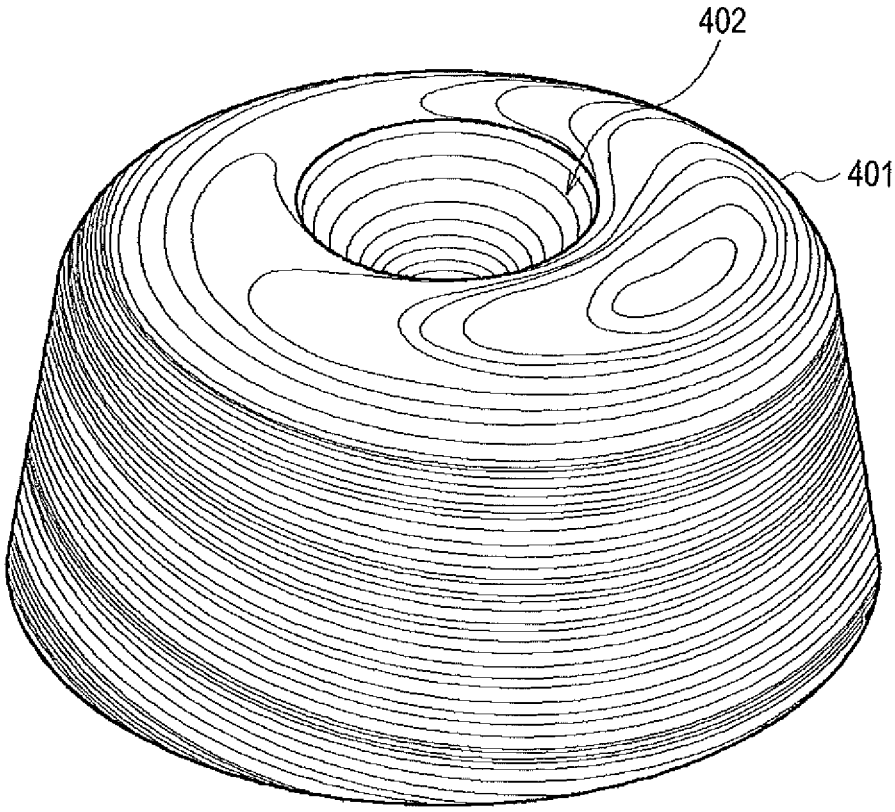
FIG. 16 is a schematic perspective view showing an appearance structure of a speaker device according to a second embodiment.
Figure 17A:
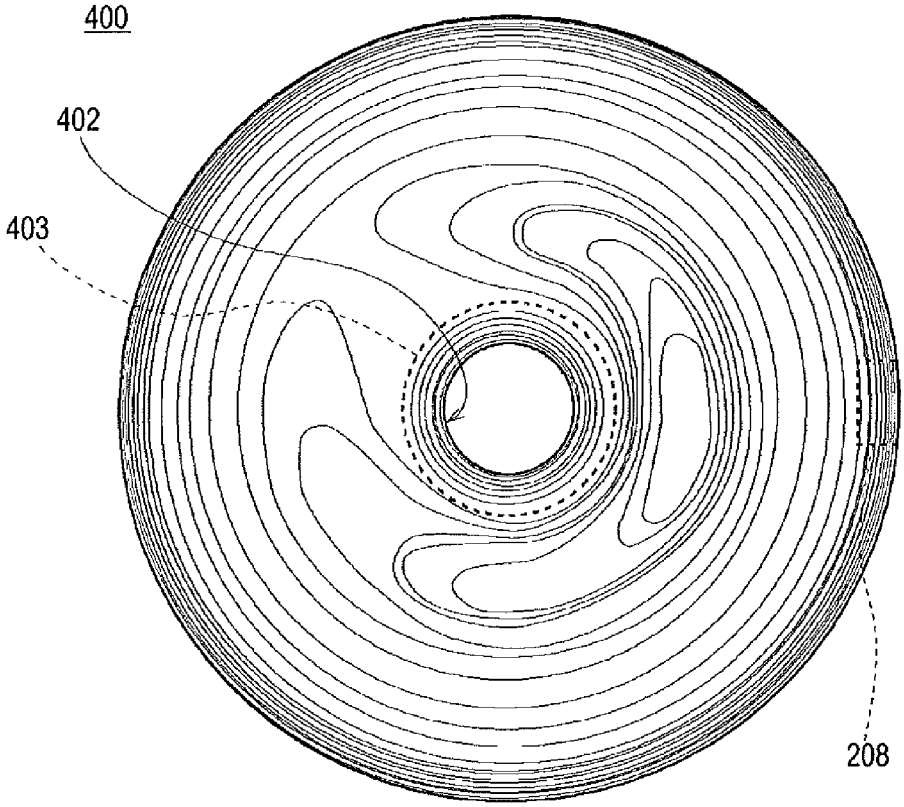
FIGS. 17A and 17B are schematic views showing upper-surface and side-surface structures of the speaker device according to the second embodiment.
Figure 17B:
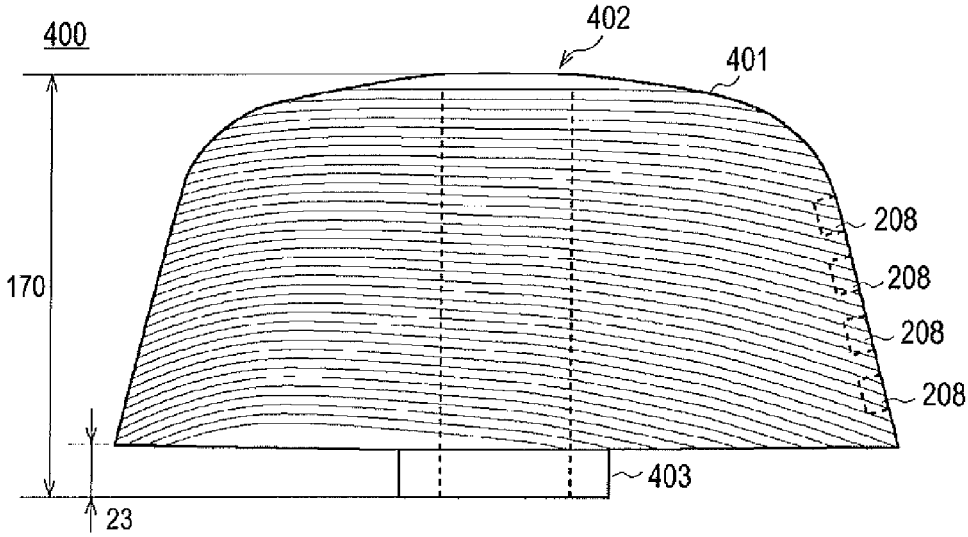

Next, a speaker device 400 using the above principle according to a second embodiment will be specifically explained as shown in FIG. 16 and FIGS. 17A and 17B.

The speaker device 400 largely differs from the speaker 200 according to the first embodiment in a point that the straight grain direction of an acoustic diaphragm 401 is not the vertical direction but the circumferential direction and a point that attaching positions of actuators (described later) are different.

[3-1 Appearance Structure of the Speaker Device]

As shown in FIG. 16, the speaker device 400 has an acoustic diaphragm 401 having a conical trapezoid shape on the whole with an internal space formed therein, and a through hole 402 is formed from the top to the bottom of the acoustic diaphragm 401 so as to pierce through the center.

The speaker device 400 includes the acoustic diaphragm 401 also made of wood, which is formed so that the straight grain direction is circumferential direction in the drawing.

The acoustic diaphragm 401 of the speaker device 400 is manufactured by being cut from a piece of wood, however, it is also possible to manufacture the diaphragm by being cut from plural wood blocks which are adhered so that wood grains are aligned.

As shown in FIGS. 17A and 17B, the speaker device 400 is provided with a pipe-shaped leg portion 403 having a given diameter on the same axis as the through hole 402, having a structure in which the leg portion 403 is integrally formed with the acoustic diaphragm 401 having the conical trapezoid shape.

The leg portion 403 protrudes downward from the lower end face of the acoustic diaphragm 401 by approximately 23 mm, which is formed so that the lower end face of the acoustic diaphragm 401 does not touch a setting surface of the floor, for example, when set on the floor. The speaker device 400 has a height of approximately 170 mm measured from the setting surface of the floor to the upper surface of the acoustic diaphragm 401.

Figure 18:
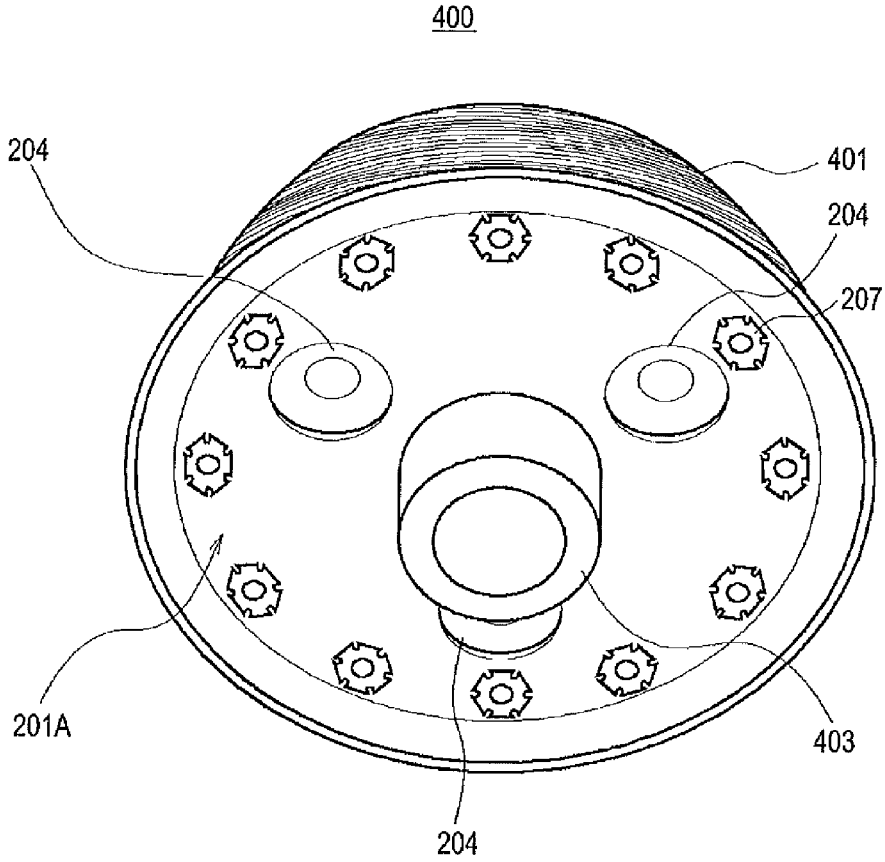
FIG. 18 is a schematic perspective view showing a bottom surface structure of the speaker device according to the second embodiment.

Also in the speaker device 400, a lower end of the acoustic diaphragm 401 is closed by the donut-shaped plate 201A made of resin and so on to form an internal space as shown in FIG. 18 in which the same codes are given to portions corresponding to FIG. 10 in the same manner as the speaker device 200 (FIG. 10).

Further, in the speaker device 400, the total of three speaker units 204 for low-middle frequency sound are arranged in a ring state at intervals of 120 degrees on a circumference of the plate 201A about the leg portion 403 protruding from the plate 201A.

Additionally, the speaker device 400 is provided with the total of twelve LED devices 207 arranged in a ring state at intervals of 30 degrees at the outer circumference of the plate 201A attached at the lower end of the acoustic diaphragm 401.

[3-2. Cross-Sectional Structure of the Speaker Device]

Figure 19:
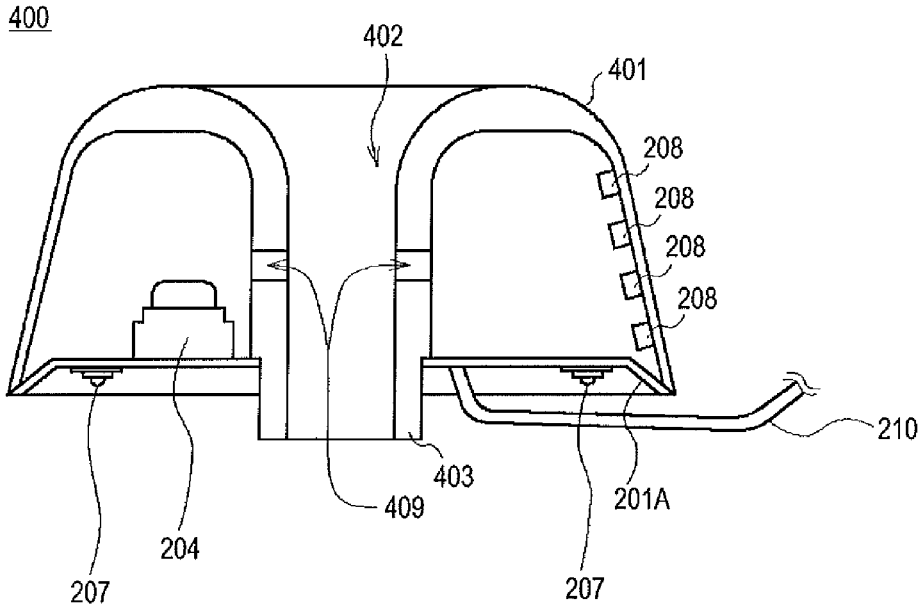
FIG. 19 is a schematic perspective view showing a cross-sectional structure of the speaker device according to the second embodiment.

As shown in FIG. 19 in which the same codes are given to portions corresponding to FIG. 11, the speaker device 400 has the structure in which the speaker units 204 provided in the inner space of the acoustic diaphragm 401 having the conical trapezoid shape are attached to the reverse-surface side of the plate 201A and diaphragm portions of the speaker units 204 are exposed from the surface side of the plate 201A.

In this case, the lower end of the acoustic diaphragm 401 of the speaker device 400 is closed by the plate 201A, the acoustic diaphragm 401 and the plate 201A function as an enclosure with respect to the speaker units 204 attached to the plate 201A.

In the speaker device 400, ducts 409 having a given diameter are provided at a side wall integrally formed with the leg portion 403 of the acoustic diaphragm 401 in a state of connecting to the through hole 402 as well as facing each other at a total of two positions, and the ducts 409 and the through hole 402 form a bass reflex port by the structure.

Also in the speaker device 400, the total of four actuators 208 for exciting a side wall in the circumferential direction are attached to the side wall on the outer circumference side of the acoustic diaphragm 401 at four stages of height positions in the circumferential direction in a state of being concealed inside the acoustic diaphragm 401.

Here, as the actuator 208, for example, a piezoelectric actuator, a magnetostrictive actuator and a dynamic actuator are used.

At this time, in the speaker device 400, portions in the circumferential direction corresponding to the four-stages of height positions at the side wall on the outside of the acoustic diaphragm 401 are excited by longitudinal waves and the vibration elastic waves are propagated in the circumferential direction (straight grain direction) of the acoustic diaphragm 401 and emitted to the acoustic diaphragm 401 as mixed waves in which longitudinal waves and transverse waves are mixed, as a result, the sound image uniform over the whole of the acoustic diaphragm 401 in the circumferential direction corresponding to the four-stages of height directions is formed.

Accordingly, the acoustic diaphragm 401 forms a speaker taking charge of high-ranges of an audio frequency band to function as a tweeter as well as the speaker unit 204 forms a speaker taking charge of middle-low ranges of the audio frequency band to function as a woofer in the speaker unit 400.

Figure 20:
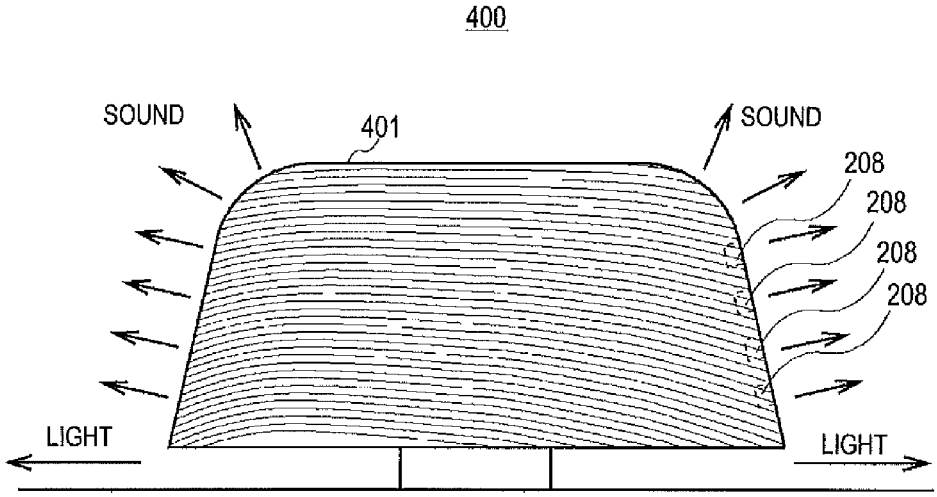
FIG. 20 is a schematic view showing a straight grain direction and an excitation direction of actuators according to the second embodiment.

Incidentally, the speaker device 400 is provided with four actuators 208 at the four-stages of height positions in the circumferential direction of the side wall so that the excitation direction corresponds to the straight grain direction of the acoustic diaphragm 401 as shown in FIG. 20.

Here, the four actuators 208 attached at the four-stages of height positions respectively are driven by individual four types of audio signals and excite the acoustic diaphragm 401 by vibration components in the circumferential direction with respect to the side wall on the outer circumference side of the acoustic diaphragm 401. At this time, respective vibration components in accordance with four types of audio signals are propagated along the straight grain direction efficiently and are difficult to be propagated in the direction orthogonal to the straight grain direction.

That is, the speaker device 400 is provided with four actuators 208 which are attached so that the excitation direction corresponds to the straight grain direction of the acoustic diaphragm 401, mixture of respective vibration components by the four actuators 208 can be avoided and crosstalk can be drastically reduced.

Incidentally, the code 210 for inputting four types of audio signals from the outside and supplying the signals to four actuators 208 and three speaker units 204 is connected to the speaker 400 (FIG. 19), which is assumed to be used in a state of, for example, being attached to a room wall and the like through the leg portion 403.

The speaker device 400 houses a not-shown power supply battery and an amplifier inside the acoustic diaphragm 401, allowing the speaker device 400 to function as an active speaker. However, it is not always necessary that the power supply battery, the amplifier and the like are housed, and that the speaker device 400 may function only as a passive speaker not including the power supply battery, the amplifier and the like.

As explained in [2-3. Frequency characteristics in the sound pressure level due to the difference of materials], the vibration propagation attenuation in the circumference direction becomes larger due to the straight grains in the case of including the acoustic diaphragm 401 using wood as a material as compared with the case of including the acoustic diaphragm using resin such as acrylic as the material also in the speaker device 400.

As the acoustic diaphragm 401 in which the circumferential direction corresponds to the straight grain direction is used in the speaker device 400, diffraction of vibration components in the vertical direction is smaller in the acoustic diaphragm 401 and crosstalk can be drastically reduced.

As configuration of the driving system of the speaker device 400 is basically the same as the speaker device 200, the explanation thereof is omitted here.

[3-3. Operation of the Speaker Device]

Subsequently, operation of the speaker device 400 (FIG. 16 to FIG. 20) will be explained.

In the speaker device 400, the four actuators 208 (208A to 208D) provided inside the acoustic diaphragm 401 is driven by the left-audio signal AL and the right-audio signal AR and excite the acoustic diaphragm 401 by the vibration components toward the circumferential direction of the acoustic diaphragm 401.

At this time, the acoustic diaphragm 401 is excited by longitudinal waves and elastic waves (vibration) are propagated through the acoustic diaphragm 401 in the circumferential direction. Then, when the elastic waves are propagated in the acoustic diaphragm 401, mode conversion of longitudinal waves, transverse waves, longitudinal waves . . . is repeated to be mixed waves of longitudinal waves and transverse waves. Vibrations in the in-plane direction (direction vertical to the surface) of the acoustic diaphragm 401 are excited by the transverse waves.

According to the above, the speaker device 400 emits sound waves from the surface of the acoustic diaphragm 401. That is, the speaker device 400 can obtain high-frequency audio output from the outer surface of the acoustic diaphragm 401.

The speaker device 400 can also obtain middle-low frequency audio output from the three speaker units 204 attached on the plate 201A as the lower end face of the acoustic diaphragm 401 does not touch the setting surface of the floor due to the leg portion 403 as well as can increase the low-frequency range as the bass reflex port is formed by the ducts 209 and the through hole 402.

[3-4. Illumination Effects in the Speaker Device]

The speaker device 400 (FIG. 18) can obtain illumination effects which allows light to leak out around the acoustic diaphragm 401 to be brightened by irradiating the lower part of the acoustic diaphragm 401 with irradiated light from the total of twelve LED devices 207 attached to the plate 201A.

As the speaker device 400 has a structure in which it does not look like the speaker in appearance, therefore, the speaker device 400 can be used not only as the audio output means but also as a decorative illumination means such as a bedside lamp or indirect lighting of a room.

In the above structure, the speaker device 400 includes four actuators 208 attached so as to allow the excitation direction to correspond to the straight grain direction of the acoustic diaphragm 401 formed so that grains are vertical by using anisotropy of the acoustic diaphragm 401 having the conical trapezoid shape.

According to the structure, the speaker device 400 adds not only the shape of the acoustic diaphragm 401 but also the propagation direction of sound waves by the anisotropy of the acoustic diaphragm 401 as parameters for changing the front-wave shape of sound waves emitted from the acoustic diaphragm 401 and frequency characteristics in the sound pressure level, which can extend a controllable area of sound-image localization and the sense of extent.

The speaker device 400 also drives four actuators 208 by independent four types of audio signals to excite the acoustic diaphragm 401 by vibration components in the circumferential direction (straight grain direction) with respect to the side wall on the outer circumference side of the acoustic diaphragm 401.

According to the above structure, respective vibration components corresponding to four-types of audio signals are propagated along the straight grain direction of the acoustic diaphragm 401 efficiently, and sound images uniform over the whole acoustic diaphragm 401 in the circumferential direction can be formed in the speaker device 400.

Furthermore, four actuators 208 are attached so that the excitation direction corresponds to the straight grain direction of the acoustic diaphragm 401 in the speaker device 400, therefore, propagation loss in the direction orthogonal to the straight grain is large in respective vibration components by the four actuators 208 and mixture of the vibration components can be avoided, as a result, crosstalk can be previously prevented to obtain good acoustic characteristics.

The speaker device 400 also allows light to leak out around the acoustic diaphragm 401 to be brightened by irradiated light from the total of twelve LED devices 207 attached to the plate 201A.

According to the structure, the speaker device 400 can function as the audio output means capable of obtaining good acoustic characteristics while preventing the crosstalk as well as can function as the decorative illumination means.

According to the above configuration, the speaker device 400 is provided with four actuators 208 so as to allow the excitation direction to correspond to the straight grain direction of the acoustic diaphragm 401 by using anisotropy of the acoustic diaphragm 401 having the conical trapezoid shape formed so that the wood grains are horizontal to thereby prevent crosstalk previously due to mixture of respective vibration components by the four actuators 208 and obtain good acoustic characteristics.

<4. Other Embodiments>

Figure 21:
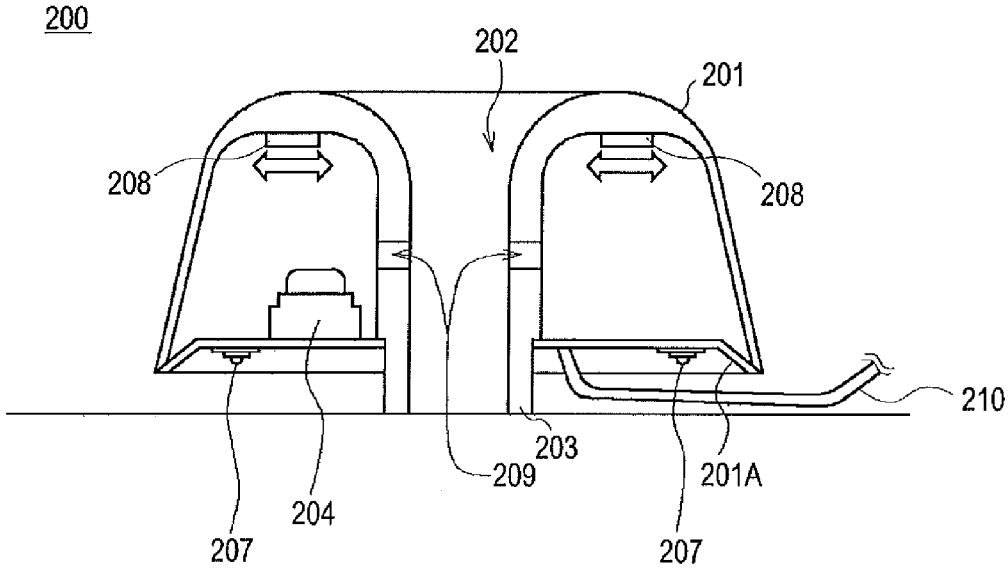
FIG. 21 is a schematic cross-sectional view showing an attaching state (1) of actuators according to another embodiment.

In the above first embodiment, the case where the total of four actuators 208 for exciting the side wall in the direction of arrows H are attached in a ring state at intervals of 90 degrees inside the acoustic diaphragm 201 as well as at the lower part of the side wall on the outer circumference side of the acoustic diaphragm 201 has been described. However, the present disclosure is not limited to this, and it is also preferable that, for example, three, six, eight or the various numbers of actuators 208 for exciting the side wall in a direction of arrows J are attached in the ring state at intervals of 90 degrees inside the acoustic diaphragm 201 as well as at a ceiling portion of the sidewall of the acoustic diaphragm 201 as shown in FIG. 21.

Figure 22:
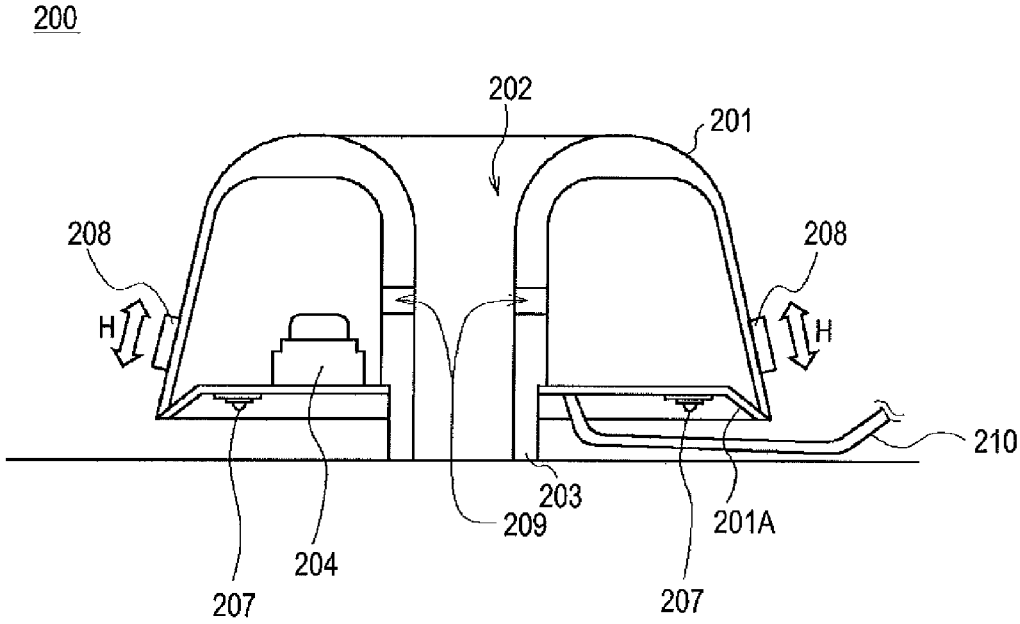
FIG. 22 is a schematic cross-sectional view showing an attaching state (2) of actuators according to further another embodiment.

Additionally, as shown in FIG. 22, it is also preferable that, for example, three, six, eight or the various numbers of actuators 208 for exciting the side wall in the direction of arrows H are attached in the ring state at intervals of 90 degrees outside the acoustic diaphragm 201 as well as at the lower part of the side wall on the outer circumference side of the acoustic diaphragm 201.

Figure 23:
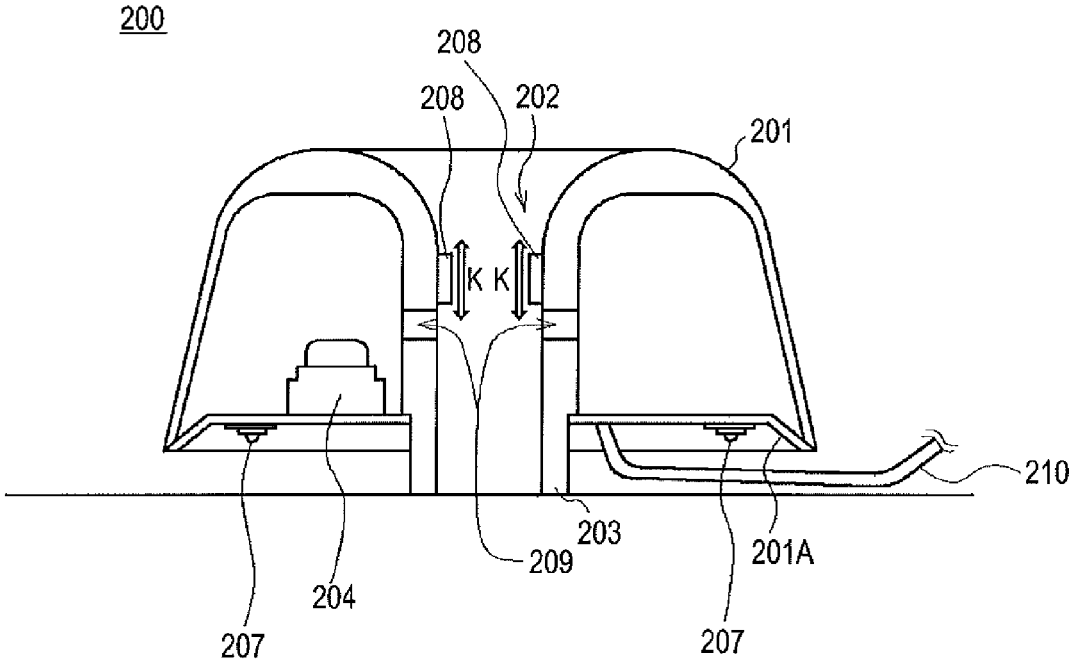
FIG. 23 is a schematic cross-sectional view showing an attaching state (3) of actuators according to further another embodiment.
Figure 24:
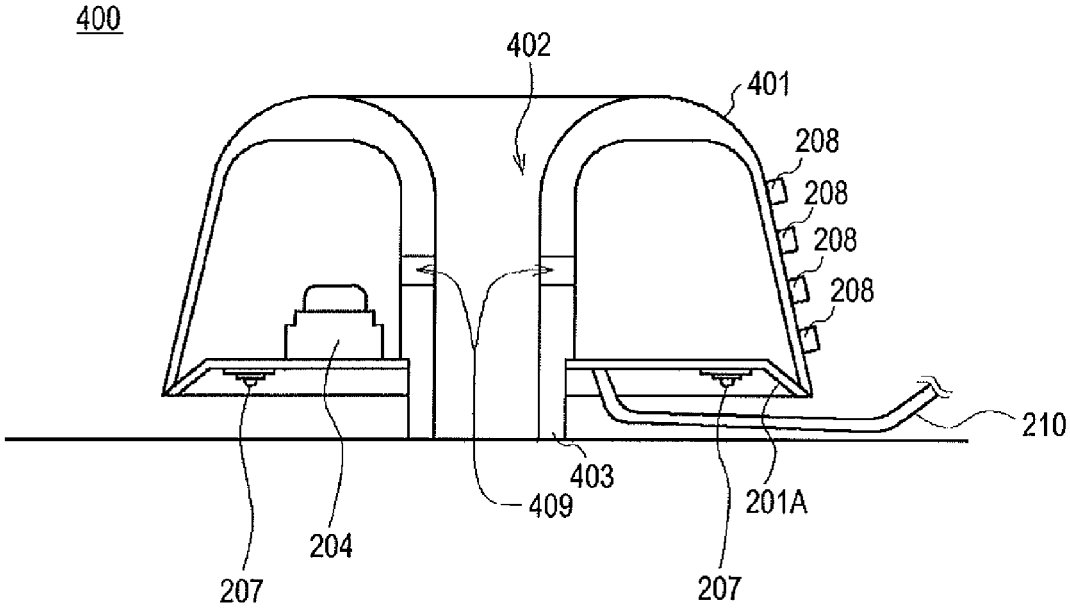
FIG. 24 is a schematic cross-sectional view showing an attaching state (4) of actuators according to further another embodiment.

Furthermore, as shown in FIG. 23, it is also preferable that, for example, three, six, eight or the various numbers of actuators 208 for exciting the side wall in a direction of arrows K are attached in the ring state at intervals of 90 degrees outside the acoustic diaphragm 201 as well as at the side wall forming the through hole 202 of the acoustic diaphragm 201.

In the above second embodiment, the case where the total of four actuators 208 for exciting the side wall in the circumferential direction are attached inside the acoustic diaphragm 401 at the four-stages of height positions at the sidewall on the outer circumferential side of the acoustic diaphragm 401 has been described. However, the present disclosure is not limited to this, and it is also preferable that the total of four actuators 208 for exciting the side wall in the circumferential direction at the four-stages of height positions are attached outside the acoustic diaphragm 401 at the side wall on the outer surface side of the acoustic diaphragm 401.

Additionally, in the first and second embodiments, the cases where the acoustic diaphragms 201, 401 using wood as the material have been explained, however, the present disclosure is not limited to this, and acoustic diaphragms 201, 401 made of resin, carbon and other various materials can be used as long as materials can give physical anisotropy in a given direction such as the straight grain direction, a flat grain direction of wood or the like.

Furthermore, in the first and second embodiments, the case where the acoustic diaphragms 201, 401 having the conical trapezoid shape are used has been described. However, the present disclosure is not limited to this, and acoustic diaphragms having other various shapes can be used such as a pipe shape, a plate shape and so on as long as materials thereof have physical anisotropy.

Furthermore, in the first and second embodiments, the cases where the acoustic diaphragms 201, 401 in which the straight grain direction is aligned to the vertical direction and the circumference direction are used have been described. However, the present disclosure is not limited to this, and the acoustic diaphragm in which various types of wood grains such as in the straight grain direction and the flat grain direction are mixed by manufacturing the diaphragm by being cut from plural wood blocks which are adhered so that wood grains are not aligned.

Furthermore, in the first and second embodiments, the case where the ducts 209, 409 are formed has been described. However, the present disclosure is not limited to this, and it is not always necessary to form the ducts 209, 409 when there is little necessity for allowing the through holes 202, 402 to function as the bass reflex port.

Furthermore, in the first and second embodiments, the case where the speaker device according to the embodiments of the present disclosure is formed by using the acoustic diaphragms 201, 401 as the acoustic diaphragm and actuators 208 as the excitation means has been described. However, the present disclosure is not limited to this and the speaker device can be formed by using the acoustic diaphragm and the excitation means having other various structures and shapes.

The speaker device according to the embodiments of the present disclosure can be applied to lighting apparatuses mainly used as interior decoration in which the audio output means is incorporated.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker device comprising:

an acoustic diaphragm having a given shape and made of a material having physical anisotropy; and an excitation means attached to the acoustic diaphragm for exciting vibration components in consideration of a direction corresponding to the physical anisotropy wherein the acoustic diaphragm has a conical trapezoid shape, and wherein the acoustic diaphragm has a through hole at a center of the conical trapezoid shape such that the through hole extends from a top of the acoustic diaphragm to a bottom thereof so as to pierce through the center of the conical trapezoid shape, where in the through hole functions as a bass reflex port through a duct provided at the side wall of the acoustic diaphragm with respect to the internal space.

2. The speaker device according to claim 1, wherein the acoustic diaphragm uses wood as the material, and the excitation means is attached so as to be along a straight grain direction of the wood as the direction corresponding to the physical anisotropy.

3. The speaker device according to claim 2, wherein the excitation means is attached to a side wall of the acoustic diaphragm having the conical trapezoid shape in a concealed manner.

4. The speaker device according to claim 3, wherein the acoustic diaphragm is attached so that a diaphragm of a speaker unit is exposed from a plate provided at a bottom surface of the conical trapezoid shape as well as a body of the speaker unit is housed in an internal space formed by the acoustic diaphragm and the plate.

5. The speaker device according to claim 4, wherein the acoustic diaphragm is attached in a state in which a light emitting device is exposed from the plate.

6. The speaker device according to claim 1, in which the acoustic diaphragm has a conical trapezoid shape and is made of wood; and in which a grain direction of the wood of the acoustic diaphragm is in a circumferential direction.

7. The speaker device according to claim 6, in which the through hole extends in a vertical direction of the conical trapezoid shaped acoustic diaphragm and in which the circumferential direction is not the vertical direction.

* * * * *